US006229131B1

(12) United States Patent
Koochaki

(10) Patent No.: US 6,229,131 B1
(45) Date of Patent: May 8, 2001

(54) MICROWAVE COOKING GRILL AND STEAMER

(75) Inventor: Kamel K. Koochaki, Loveland, OH (US)

(73) Assignee: Kontract Product Supply, Inc., Loveland, OH (US)

( * ) Notice: Subject to any disclaimer, the term of this patent is extended or adjusted under 35 U.S.C. 154(b) by 0 days.

(21) Appl. No.: 09/289,914

(22) Filed: Apr. 13, 1999

Related U.S. Application Data

(63) Continuation-in-part of application No. 08/681,184, filed on Jul. 22, 1996, now Pat. No. 5,935,477.

(51) Int. Cl.[7] ..... H05B 6/80

(52) U.S. Cl. ..... 219/731; 219/730; 219/732; 219/734; 99/DIG. 14; 426/243

(58) Field of Search ..... 219/731, 730, 219/725, 732, 729, 734; 99/DIG. 14, 451; 426/241, 243

(56) References Cited

U.S. PATENT DOCUMENTS

| | | | |
|---|---|---|---|
| 3,271,552 | | 9/1966 | Krajewski . |
| 3,591,751 | | 7/1971 | Goltsos et al. . |
| 3,835,280 | | 9/1974 | Gades et al. . |
| 3,845,266 | | 10/1974 | Derby . |
| 3,941,967 | | 3/1976 | Sumi et al. . |
| 3,941,968 | | 3/1976 | MacMaster et al. . |
| 3,946,187 | | 3/1976 | MacMaster et al. . |
| 4,230,924 | | 10/1980 | Brastad et al. . |
| 4,317,017 | * | 2/1982 | Bowen ..... 219/731 |
| 4,320,274 | | 3/1982 | Dehn . |
| 4,369,346 | | 1/1983 | Hart et al. . |
| 4,398,077 | | 8/1983 | Freedman et al. . |
| 4,413,167 | | 11/1983 | Martel et al. . |
| 4,477,705 | | 10/1984 | Danley et al. . |
| 4,481,392 | | 11/1984 | Nibbe et al. . |
| 4,490,597 | | 12/1984 | Mengel . |
| 4,542,271 | | 9/1985 | Tanonis et al. . |
| 4,728,762 | | 3/1988 | Roth et al. . |
| 4,825,025 | | 4/1989 | Seiferth . |
| 4,853,509 | | 8/1989 | Murakami . |
| 4,865,921 | | 9/1989 | Hollenberg et al. . |
| 4,866,234 | | 9/1989 | Keefer . |
| 4,883,936 | | 11/1989 | Maynard et al. . |
| 4,888,459 | | 12/1989 | Keefer . |

(List continued on next page.)

FOREIGN PATENT DOCUMENTS

| | | |
|---|---|---|
| 56-42022 | 4/1981 | (JP) . |
| 63-30222 | 12/1988 | (JP) . |
| 4-143520 | 5/1992 | (JP) . |

*Primary Examiner*—Philip H. Leung
(74) *Attorney, Agent, or Firm*—Dinsmore & Shohl LLP

(57) ABSTRACT

A microwave cooking grill comprises a grill element which is a continuous conductive loop shaped into a plurality of linear segments. Substantially the entire loop is capable of collecting microwave energy without the use of designated antenna portions. In one embodiment, the grill elements are provided within a microwave cooking grill and steamer which has a bottom tray and a top lid. A pair of grill assemblies are provided each of which includes a plurality of the grill elements attached to a rack. One of the grill assemblies is placed within the tray and the other grill assembly is attached to the lid. A comestible is placed between the grill assemblies whereby the continuous grill elements of each grill assembly contact the comestible and grill the comestible as the grill elements absorb microwave energy. Alternatively, the grill assemblies may be flipped whereby the grill elements face away from the comestible and the comestible is sandwiched between flat steaming surfaces of each rack. Water is placed within a middle compartment of the tray. As the water is heated to its boiling point, the water is converted into steam which flows through openings formed within the rack to steam cook the comestible.

21 Claims, 13 Drawing Sheets

U.S. PATENT DOCUMENTS

| | | | | |
|---|---|---|---|---|
| 4,923,704 | | 5/1990 | Levinson . | |
| 4,934,829 | | 6/1990 | Wendt . | |
| 4,952,764 | | 8/1990 | Harrington . | |
| 4,992,636 | | 2/1991 | Namiki et al. . | |
| 5,004,882 | | 4/1991 | Nottingham et al. . | |
| 5,045,660 | * | 9/1991 | Levinson | 219/730 |
| 5,057,659 | | 10/1991 | Schneider et al. . | |
| 5,107,087 | | 4/1992 | Yamada et al. . | |
| 5,144,106 | | 9/1992 | Kearns et al. . | |
| 5,151,568 | | 9/1992 | Rippley . | |
| 5,154,114 | | 10/1992 | Change . | |
| 5,223,685 | | 6/1993 | DeRienzo, Jr. . | |
| 5,254,820 | | 10/1993 | Pesheck et al. . | |
| 5,280,150 | | 1/1994 | Arai et al. . | |
| 5,310,980 | | 5/1994 | Beckett . | |
| 5,313,878 | | 5/1994 | Strait, Jr. . | |
| 5,322,984 | | 6/1994 | Habeger, Jr. et al. . | |
| 5,354,973 | | 10/1994 | Beckett . | |
| 5,370,042 | | 12/1994 | Tolchin et al. . | |
| 5,396,052 | | 3/1995 | Petcavich et al. . | |
| 5,397,879 | | 3/1995 | Geissler . | |
| 5,484,765 | | 1/1996 | Dionne et al. . | |
| 5,493,103 | | 2/1996 | Kuhn . | |
| 5,558,798 | | 9/1996 | Tsai . | |
| 5,698,127 | | 12/1997 | Lai et al. . | |

* cited by examiner

MICROWAVE COOKING GRILL AND STEAMER

RELATED APPLICATION

This application is a continuation-in-part of application Ser. No. 08/681,184, filed on Jul. 22, 1996, U.S. Pat. No. 5,935,477 the entire disclosure of which is hereby incorporated herein by reference.

FIELD OF THE INVENTION

The present invention relates to a grilling apparatus for use in a microwave oven, and, in a preferred embodiment, to a continuous conductive grill element loop designed to grill food products in a microwave oven without substantial arcing and/or overheating. The continuous conductive grill element loops of the present invention can be used alone or in combination with other grill elements of the present invention to simultaneously grill and cook food.

The present invention also relates to a microwave grilling and steaming apparatus with which a grill element can be utilized. More particularly, in a preferred embodiment, the present invention relates to a microwave cooking grill and steamer having a continuous conductive grill element loop which is designed to grill food products in a microwave oven without substantial arcing and/or overheating, and which is designed to steam food in a microwave oven by converting a quantity of water contained within the apparatus to steam. The loop can be secured to a grilling surface of a rack which is opposite a steaming surface on the rack.

BACKGROUND OF THE INVENTION

Microwave ovens have become increasingly popular in recent years due in large part to the speed with which a conventional microwave oven can cook certain foods. Microwave ovens produce high frequency, electromagnetic energy fields which cause certain molecules to oscillate at a greater rate thereby producing heat. For example, a water molecule has a dipole which absorbs microwave energy and indirectly converts that microwave energy to thermal energy. The heat produced by the interaction of microwave energy and water molecules is generally not greater than about 100° C. because the water evaporates at that point. Many food substances comprise sufficient quantities of water, or other microwave absorbing materials, to make them susceptible to microwave cooking.

In a conventional oven, electricity, gas, wood, etc. is converted to thermal energy. The thermal energy is transmitted to the air within the oven, the oven walls, the oven racks, the food being cooked and the container the food is being cooked in. Additionally, conventional ovens operate by heating the outside of the food being cooked and wherein the interior portion of the food being cooked is heated by the conduction of thermal energy from the exterior surface of the food to the interior. Cooking food from the exterior surface inward is both slow and inefficient because, as mentioned briefly above, the entire interior of the oven and all the contents of the oven must be heated. However, conventional ovens, while slow and generally energy inefficient, have one perceived advantage over conventional microwave ovens. Because the thermal energy envelopes the exterior of the food being cooked it is often possible to "brown" and/or "crisp" the exterior of the food product. It has heretofore been difficult to brown or crisp food in a conventional microwave oven.

Microwave ovens, which typically operate at 2450 MHZ, supply microwave energy which is absorbed by the "lossy" component of foods. A lossy component is any portion of food, or other product, which absorbs microwave energy and converts at least a portion of that microwave energy to thermal energy. Microwave ovens are typically designed so that the microwave energy is not absorbed by the interior surfaces of the microwave. Thus, microwave energy does not generally heat the interior surfaces of the microwave oven. While the microwave cooking process is energy efficient, the exterior of the food product is typically cooked at the same rate as the interior of the food. Thus, browning and/or crisping of the food's exterior generally does not occur in a microwave oven.

There have been many attempts to rectify this shortcoming of microwave ovens, i.e., to brown and/or crisp food while cooking it in a microwave oven. For example, U.S. Pat. No. 5,493,103, which issued on Feb. 20, 1996 to Kuhn, discloses a baking utensil which essentially surrounds the food being cooked with a layer of material containing ferrite particles. The ferrite particles absorb microwave energy, and convert it to thermal energy until the Curie temperature of the ferrite is reached. The Curie temperature is a characteristic of the ferrite and different particles can be selected depending upon their Curie temperatures and the desired cooking results. When the Curie temperature is reached the particulate ferrite layer reflects excess microwave energy away from the food.

The process described by Kuhn is inherently inefficient in that some of the microwave energy is reflected away from the food. Moreover, because the food is completely surrounded by a particulate ferrite layer, the microwave energy is not transmitted directly to the food but must generally be converted to thermal energy. The conversion of microwave energy to thermal energy essentially eliminates the benefits of microwave cooking, i.e., the speed associated with the direct absorption of microwave energy by molecules in the food being cooked. Thus, while it may be possible to shield food from microwave energy and convert the microwave energy to thermal energy, this process essentially converts the microwave oven to an inefficient conventional thermal conduction oven.

U.S. Pat. No. 5,396,052, which issued on Mar. 7, 1995 to Betcavich, et al. discloses a cooking pot having a lid wherein the base material of the pot and lid is essentially transparent to microwave energy. The interior of the cooking pot is glazed with a microwave absorbing material. The food inside of the pot is cooked by normal thermal conduction as the interior glaze both converts microwave energy to thermal energy and reflects excess microwave energy away from the food inside of the container. While this configuration may provide the desired browning and/or crisping on the exterior of the food, it does not retain the speed and energy efficiency of a conventional microwave oven.

As an alternative to completely encasing food in a microwave absorbing material, a suceptor layer, or layers, of microwave absorbing material have been used in an attempt to brown at least a portion of the exterior of food placed on the suceptor layer. In general, any material that converts microwave energy to thermal energy is considered a "suceptor". However, the term suceptor is often used to refer to a layer of microwave absorbing material. For example, U.S. Pat. No. 4,542,274, which issued on Sep. 17, 1985 to Tanonis, et al. describes a microwave cooking pan, for example a pie pan, wherein a layer of plastic with magnetic particles disbursed evenly throughout is used as a heating layer. The heating layer converts microwave energy to thermal energy thereby browning at least a portion of one surface of the food placed thereupon.

Additionally, U.S. Pat. No. 5,144,106, which issued on Sep. 1, 1992 to Kearns, et al. uses a layer of cooking oil or fat as a suceptor. The oil or fat is separated from the food being cooked by a material which can conduct heat from the oil or fat to the food. The fat or oil absorbs microwave energy, converts it thermal energy which is conducted to the layer of material between the food and the oil. Thus, a surface is provided where the food can be cooked both by thermal conduction and microwave absorption. The fat or oil produces a temperature in excess of 100° C. on which to cook the food because fats and oils typically boil at a much higher temperature. A typical microwave oven can heat cooking oil or fat to a temperature of from about 125° C. to 225° C.

The references discussed above utilize flat, essentially continuous layers of material which absorb microwave energy, reflect microwave energy or both. Flat continuous sheets of suceptor material were generally preferred in the past to avoid the problem of "arcing" and/or localized overheating of the conductive element. Arcing, and localized overheating can burn food in the microwave oven, damage the microwave oven itself, and in extreme cases cause fires to start within the microwave oven. For example, a small pin hole in a metallic layer can cause arcing across the hole which results in sparks and/or damage to the metallic layer. Decorative utensil handles, for example forks, spoons and the like, often "arc" due to the multiple edges, layers and non-uniformities in the metallic structure. Likewise, the ends of exposed elements, for example the rods disclosed in U.S. Pat. No. 3,591,751 which issued Jul. 6, 1971 to Goltsos, can arc and/or overheat near the tips of the rods.

Attempts have been made to design suceptors which are not flat and continuous sheets of microwave absorbing material. For example, U.S. Pat. No. 5,322,984, which issued on Jun. 21, 1994 to Habeger, Jr. et al., shows a series of "antenna" elements which are used to collect microwave energy, convert it to thermal energy and transmit the thermal energy to the grill element which is in contact with the food being cooked. It has been observed that antenna configurations similar to those disclosed in the patent to Habeger Jr. et al. can cause localized areas of overheating near the antenna ends, and arcing can also occur. Additionally, the antenna configuration also requires that a substantial portion of the element be placed away from the food which results in a significant amount of heat being generated at the antennas which is not directly transmitted to the food.

Thus, there has been a continuing need for an efficient microwave grill apparatus which can convert microwave energy to thermal energy to brown and/or crisp the exterior surface of a food product. Moreover, there exists a need for a microwave grilling apparatus which can grill food while at the same time avoiding arcing and/or localized areas of overheating in the apparatus. Additionally, there is a need for a microwave grilling apparatus which maintains the benefits of microwave cooking, i.e., speed and energy efficiency while adding the desired browning and/or crisping function which has generally been lacking in conventional microwave cooking apparatuses.

Another type of cooking process which is difficult to perform in a microwave is to steam cook food. Food is steam cooked by placing the food above or in the same closed container with boiling water. As the water boils and evaporates into steam, the hot air produced thereby along with the pressure within the closed vessel acts to heat and steam cook the food. One problem with attempting to steam cook food in a microwave is that the microwave energy which is absorbed by the water to convert the water into steam simultaneously cooks the food thereby defeating the purpose of steam cooking. It would be advantageous to "shield" the food from the microwave energy yet allow the microwave energy to permeate through the tray to be absorbed by and boil the water. However, in order to further decrease the cooking time required to steam the food, it may be desirable to allow a small amount of the microwave energy to be transmitted to the food to assist slightly in cooking the food.

One device that attempts to address the problem of shielding a majority of the microwave energy while allowing a small portion of the microwave energy to be absorbed by the food is shown in U.S. Pat. No. 5,558,798 which discloses a microwave steam cooking apparatus having a bottom water tray formed of a material which is transparent to microwaves allowing the microwave energy to permeate therethrough and boil the water contained within the water tray. A base container which may be double layered is placed on top of the water tray. An outer layer of the base tray is formed of a material which reflects microwaves and an inner layer is formed of a material which is transparent to microwaves. A plurality of openings is formed in the outer layer to allow a small amount of the microwaves to permeate through the base container and be absorbed by the food. A top tray covers the base and is formed of a material which reflects microwaves. The top tray may also be formed with a plurality of openings to allow a small amount of the microwaves to travel therethrough. As the microwaves boil the water contained within the water tray, the steam rises through a plurality of vent holes formed in a bottom of the base container to steam the food. A small amount of microwave energy permeates through the openings of the base container and top tray to assist the steam in cooking the food.

Although this prior art microwave steam cooking apparatus is adequate to steam cook food, it does not allow both grilling and steam cooking food in a microwave oven without substantially modifying the apparatus.

Thus, there has been a continuing need for an efficient microwave grill and steamer apparatus which can convert microwave energy to thermal energy to brown and/or crisp the exterior surface of a food product and which also may be used to allow the apparatus to convert water into steam which is used to steam cook food. Moreover, there exists a need for a microwave grilling and steaming apparatus which can grill or steam food while at the same time avoiding arcing and/or localized areas of overheating in the apparatus. Additionally, there is a need for a microwave grilling and steaming apparatus which maintains the benefits of microwave cooking, i.e., speed and energy efficiency, while adding the desired browning and/or crisping function which has generally been lacking in conventional microwave cooking apparatuses. Further, there is the need for a microwave steaming apparatus which may be used to reflect a majority of the microwave energy to prevent the microwave energy from substantially cooking the food, but allows a small amount of the microwave energy to permeate through the apparatus to assist in cooking the food.

SUMMARY OF THE INVENTION

It is an object of the present invention to obviate the problems associated with conventional microwave cooking ovens discussed above.

It is an additional object of the present invention to provide a microwave grilling apparatus which combines the benefits of microwave cooking with the browning and crisping function normally found only in thermal conduction ovens, outdoor grills and the like.

It is yet another object of the present invention to provide a microwave grilling apparatus which combines the benefits of microwave cooking with browning, grilling, and crisping capability, and also with steaming functions which convert water into hot steam to cook food.

These and additional objects are provided by the present invention. Specifically, the invention, in one embodiment, is directed to a microwave grilling apparatus which comprises a grill having a continuous conductive loop. The loop has at least two spaced linear segments, and substantially the entire loop is capable of collecting microwave energy without the use of designated antenna portions.

The continuous grill element loops, and microwave grilling apparatuses described herein combine the desired benefits of the browning and crisping function normally associated only with thermal conductive heating elements, with the speed of cooking associated with a microwave oven. The continuous grill element loops of the present invention are designed to absorb microwave energy while minimizing arcing and overheating, and minimizing the amount of microwave energy reflected away from the comestible. The continuous grill element loops of the present invention provide these and other advantages while being light weight, relatively inexpensive, easy to manufacture and consuming only a small amount of space in the microwave oven.

In another preferred embodiment of the present invention, the invention is directed to a microwave grilling apparatus which comprises a grill having a continuous conductive grill element loop which is at least partially supported by a tray. The tray has a floor and at least one wall which interact to contain or absorb liquids. In an even more preferred embodiment a cover and a second continuous grill element are provided. The tray and grill element can be combined with the cover and grill element to grill a comestible, i.e., a food product, placed between the two grill elements.

In a further embodiment, a shielding plate is provided to shield the food and reflect the microwaves that are transmitted from the top of the microwave. An opening is formed in the shielding plate to allow a small amount of the microwave energy to pass therethrough to assist the grill elements in cooking the food.

In another embodiment, a grill element is provided on one side of a grill assembly, and the assembly may be flipped whereby the grill element opposes and does not contact the food. The tray is filled with water and the microwaves boil water to convert the water into steam which is used to cook the food. In one embodiment, the grill assembly comprises a rack, one side of which includes channels in which the grill element is provided. This side of the rack is the grilling surface of the assembly and can be placed in contact with food to grill the food. The opposite side is the steaming surface, and can be placed in contact with food when the assembly is flipped, in order to steam the food.

Still other objects and features of the present invention will become apparent to those skilled in this art from the following description wherein there is shown and described preferred embodiments of this invention, simply by way of illustration, and best modes contemplated for carrying out the invention. As will be realized, the invention is capable of other different aspects and embodiments without departing from the scope of the invention. Accordingly, the drawings and descriptions should be regarded as illustrative in nature and not as restrictive in nature.

BRIEF DESCRIPTION OF THE DRAWINGS

While the specification concludes with claims particularly pointing out and distinctly claiming the present invention, it is believed that the same will be better understood from the following description taken in conjunction with the accompanying drawings.

DETAILED DESCRIPTION OF PREFERRED EMBODIMENTS

Figure 1:
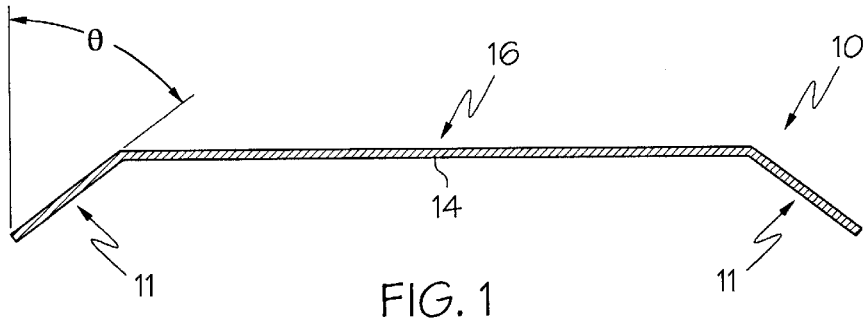
FIG. 1 is a schematic side view of one of the grill element loops of the microwave cooking grill of the present invention showing the angled sides of the grill element loop.

Referring now to the drawings in detail wherein like numerals indicate the same elements throughout the views, FIG. 1 is a schematic side view of an angled grill 16 comprising grill element 14 wherein the grill element ends 11 have been bent to an angle θ. θ is preferable between about 20° and about 70° and more preferably between about 30° and about 50°. As will be understood, conventional microwave ovens generally feed microwave energy into the cavity of the oven from a microwave source which feeds from only one direction, e.g. the top, bottom or side. While not wanting to be bound to any one theory, it is believed that the continuous grill elements of the present invention act like antennas, collecting and absorbing microwave energy. Thus, flat grills, i.e. substantially two dimensional grills, placed horizontally in the microwave oven cavity collect top and bottom fed microwave energy very efficiently. However, the angled grill of FIGS. 1 and 2 collects and absorbs microwave energy from a side fed microwave source more efficiently than do flat grills. The grills described below will generally be described as flat, but it is understood that at least a portion of the ends can be bent to improve the grill's reception of microwave energy.

Figure 2:
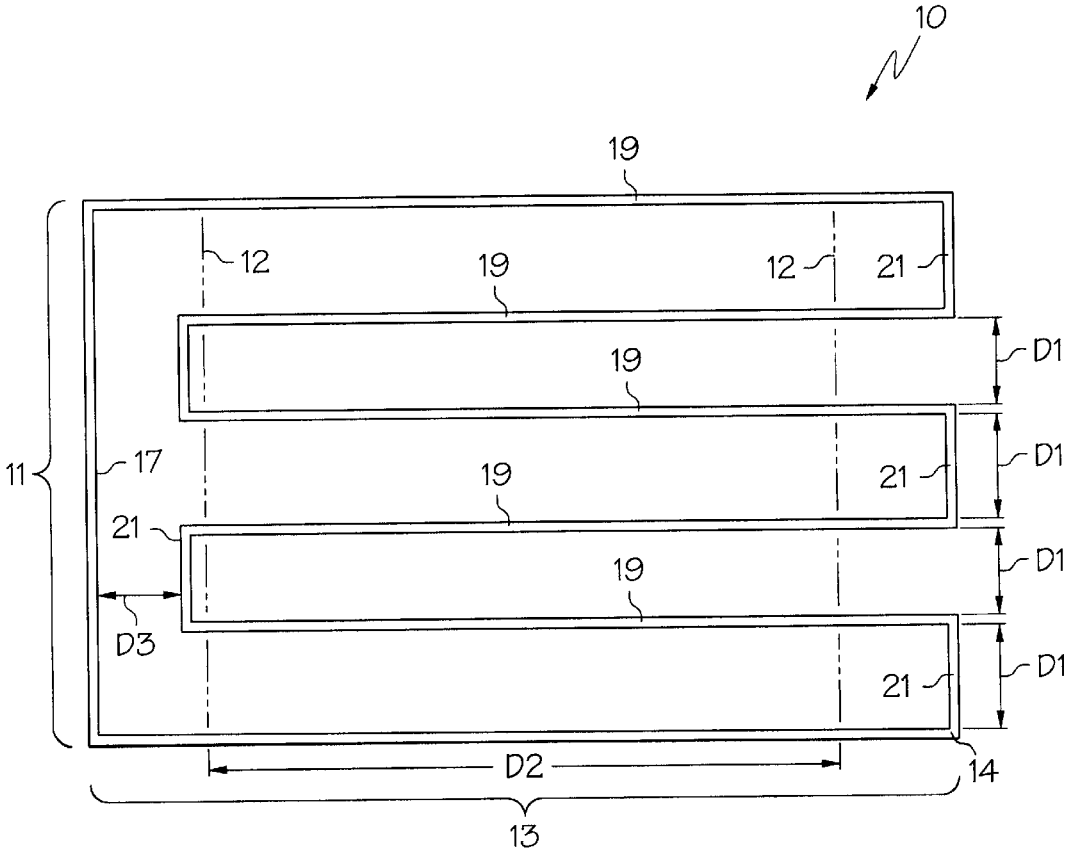
FIG. 2 is a schematic plan view of the grill element loop of FIG. 1.

FIG. 2 is a schematic plan view of the microwave grill of FIG. 1. The lines 12, along which the continuous grill element 14 is bent, are transverse to grill element sides 13. Continuous grill element 10 is one preferred embodiment of the present invention and can be used to illustrate numerous aspects of the present invention. For example, grill element 14 is substantially continuous, i.e., grill 10 comprises one continuous element. Small breaks in the continuous element might result in arcing between the broken or disjointed pieces. Likewise, a large gap in the continuous grill element 14 might avoid arcing but would still leave two element ends which may produce localized overheating.

The continuous grill element 14 comprises a series of grill element segments 19 which, in the preferred embodiment of FIG. 2, are shown substantially parallel to one another. It is additionally preferred to have the spacing D1 between adjacent element segments 19 be substantially equal between all grill element segments 19. As can be appreciated, the distance D1 can vary but it is preferred that D1 remain within relatively narrow perimeters as discussed below.

The distance D1, which indicates spacing between adjacent element segments 19, should be approximately equal to an integer value of ⅛ of the microwave wave length associated with the microwave oven being used. The vast majority of conventional microwave ovens currently in use operate at 2450 MHz. Thus, a conventional microwave oven emits microwave energy at wave lengths, or λ, approximately within the range of from about 11.5 cm to about 14.0 cm. The microwave wave length, λ, is a critical perimeter when designing the microwave grills of the present invention. As discussed above, the grills of the present invention are believed to act as an antenna which receive the microwaves. Thus, the distances described herein as multiples of λ are intended to "tune" the grill to optimize the reception and collection of the microwave energy.

While not wanting to be limited to any one theory, it is believed that spacing the element segments 19 at distances, which are integer multiples of ⅛λ, minimizes arcing between element segments 19. More specifically, it is preferred that D1 be equal to X*(⅛λ) wherein X is an integer from 1 to about 24. As can be appreciated integers encompass whole numbers i.e., 1, 2, 3 etc. It is preferable that distance D3, which is the distance between a grill element angular crossover 21 and the grill element loop completion segment 17, also be an integer multiples of ⅛λ. As will be understood, it is preferred that D3 be an integer multiple of ⅛λ, but D3 need not be equal to D1. Likewise, the entire length of the continuous elements of the present invention, for example, 14 and 114 of FIGS. 1, 2 and 3, should be an integer multiple of ½λ, i.e. X*(½λA).

As was discussed briefly above, most microwave ovens operate at 2450 MHz, this rating is typically an estimate and the microwave wavelengths generated by a conventional microwave oven will typically vary within a narrow band of microwave wavelengths. Thus, the descriptions of distances herein, which have been linked to integer multiples of a fraction of λ, are intended to encompass the entire band of λ's which normally occur in a conventional microwave oven. Thus, λ, as discussed above is intended to encompass wave lengths of from about 11.5 cm to about 14.0 cm. Thus, integer multiple of λ or integer multiples of a fraction of λ are intended to encompass any multiple that falls within the aforementioned range of λ. For example, if X =1, then X*(⅛λ) is equal to the range of from about (⅛*11.5) to about (⅛*14.0), or from about 1.44 cm to about 1.74 cm.

Figure 3:
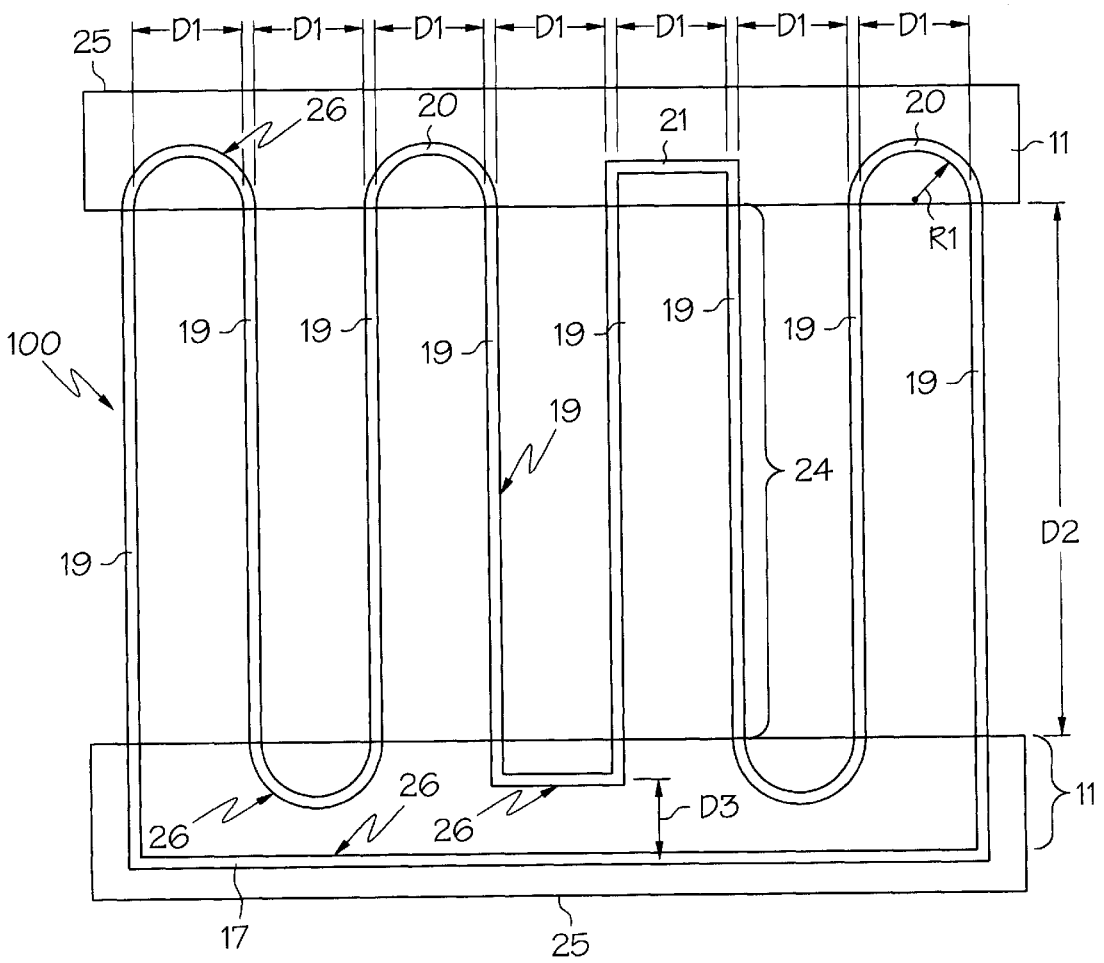
FIG. 3 is a schematic plan view of one of the grill element loops shown having insulated ends.

FIG. 3 is a schematic plan view of a microwave grill 100. The microwave grill comprises a continuous grill element 114 wherein insulation 25 has been provided on either end 11 of the continuous grill element 114. Insulation 25 is intended to be thermal insulation which can withstand sustained temperatures of above about 200° C., and which is generally transparent (i.e., neither absorbs nor reflects) microwave energy. Thus, the insulation material can be a variety of non-conductive materials, for example high density plastics, silicone rubbers, ceramics, wood and the like.

Distance D2 is the length of an exposed element segment, i.e., the portion of the continuous element segment between insulation 25. As can be seen in FIGS. 1 and 2, D2 is also the distance between bends in a non-insulated, bent embodiment of the present invention. To absorb the maximum amount of microwave energy, while minimizing the potential for arcing, it is preferred that D2 be an integer multiple of ½λ, i.e. X*(½λ). As was the case above, the integer X is intended to encompass whole numbers from 1 to about 24.

The insulated section 26 of grill element 114 should be continuous to avoid arcing and localized overheating within insulation 25. However, the configuration of the insulated section 26 is not necessarily critical. A rounded crossover 20 between grill element segments 19 is appropriate, as is angled crossover 21 between grill element segments 19. For the rounded crossovers 20 between grill elements 19 a radius R1 exists. As can be appreciated, R1 may be helpful in characterizing the continuous grill elements of the present invention, and certain radiuses may be easier to manufacturer than others, but the actual radius value itself is not critical to the functioning of the present invention. Likewise, the presence of insulation 25, while generally preferable, is not required.

As will be appreciated, if a microwave grill, e.g., 10 or 100, is neither bent nor insulated, the distance D2 will necessarily include the rounded and/or angular cross over sections, e.g., 20 and 21, and the grill element loop completion segment 17. As was discussed above, D2 is preferably an integer multiple of ½λ. Thus, the grill element segments 19 may need to be shortened or lengthened to accommodate for the added length of the grill element ends 11 if they are neither insulated or bent.

Figure 4:
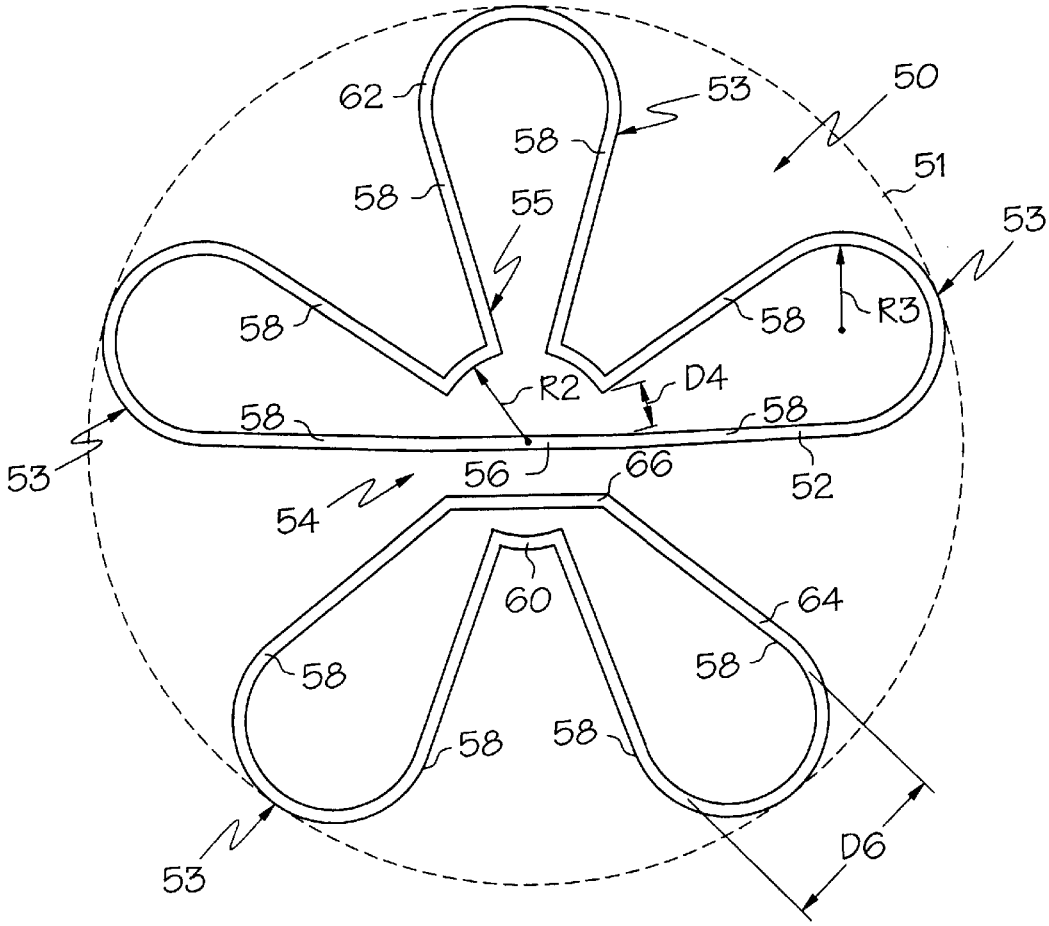
FIG. 4 is a schematic plan view of a generally petal-shaped grill element loop having a substantially round outer periphery.

FIG. 4 is a schematic plan view of an alternative embodiment of the present invention. FIGS. 1, 2 and 3 provide a generally rectangular grill which may not be optimal for all applications, for example, for cooking a round hamburger. Thus, FIG. 4 shows a round grill 50 which has an substantially round outer periphery 51. Round grill 50 comprises a plurality of petal shaped elements 53.

Petal shaped elements 53 are characterized in that distance D4, the distance between element segments 58 near the base 55 of petal shaped element 53, is less than distance D6, which is the distance between element segments 58 near crossover section 62. If D4 and D6 are approximately equal, i.e. the element segments 58 are substantially parallel, the grill will still function properly. However, the petal shaped design is intended to more uniformly space the element segments 58 around the substantially round outer periphery 51 of round grill 50. Crossover section 62 is shown as having a generally hemispherical geometry, although an angular crossover section, e.g. 21 of FIG. 3, will work as well. A series of petal shaped elements 53 are arranged around a round grill center 54. Round grill center 54 has a radius R2. Round grill center 54 is shown with two round grill center elements 56 and 66 which connect the petal shaped elements 53 in series. Continuous round grill element 52 forms an element with three petal shaped elements 53 and one round grill center element 56. Likewise, continuous round grill element 64 forms an element with two petal shaped elements 53 and one round grill center element 66. Other configurations are suitable for use herein, for example, each petal shaped element 53 can have a separate center element and a round grill, e.g. 50, can be constructed from individual petal shaped elements.

The number of petal shaped elements, and how many petal shaped elements are connected in series, are design considerations which can vary and will largely be determined by the size of round grill center 54, i.e., the length of radius R2. However, as was the case with the rectangular elements discussed above, the entire length of the continuous elements of the present invention, for example, 52 and 64, should be an integer multiple of $\frac{1}{2}\lambda$, i.e. $X^*(\frac{1}{2}\lambda)$.

Petal shaped elements 53 are further connected in series by round grill interior crossover segments 60 which connect one petal shaped element to an adjacent petal shaped element 53 near their bases 55. The length of the interior crossover segment 60 should not vary from distance D4 by more than + or −50%. It is generally preferred that the length of the interior crossover segment 60 be approximately equal to D4, but, as can be appreciated by one of ordinary skill in the art, as distance D4 and interior crossover segment 60 increase in length, fewer petal shaped elements can be incorporated on round grill 50. Thus, generally, the distance D4 and the length of the interior crossover segments 60 should be minimized to allow for the maximum number of petal shaped elements 53 to be incorporated into round grill 50.

Figure 5:
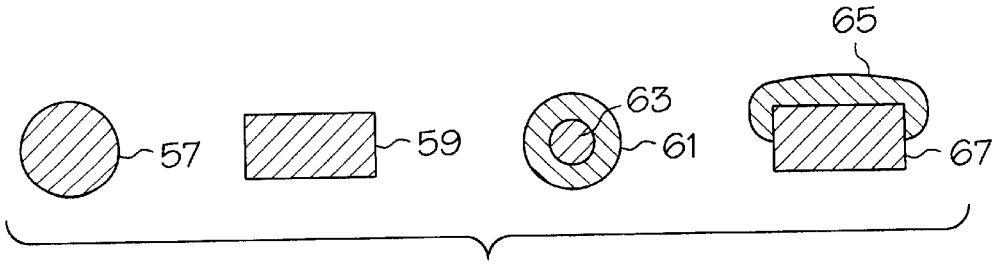
FIG. 5 is a schematic cross-sectional view of exemplary grill element loops of the present invention.

FIG. 5 is a schematic of four cross-sectional views of preferred grill elements of the present invention. Conductive grill elements of the present invention can comprise a substantially round cross-section 57, or substantially rectangular cross-section 59 of one conductive material. The conductive material of the continuous grill elements described herein can be any appropriate microwave absorbing material for example, 440C stainless steel, 312 stainless steel, aluminum, iron, nickel, copper, chrome or mixtures thereof. However, composite continuous grill elements are also suitable for use with the grills described herein. For example, a round, non-conductive or conductive core 63 can be coated with a conductive or non-conductive coating 61. Both 63 and 61 can be conductive materials, e.g., a stainless steel rod coated with a layer of ferro-magnetic particles. Particles of conductive materials can be applied to a conductive or non-conductive core by any available means. For example, particles can be flame sprayed onto the core, or particles can be applied by incorporating the metallic particles in an organic binder such as paint and/or resin material. The organic binder/particle dispersion can be brushed or sprayed on the core, likewise, the element can be dipped in the dispersion to apply the coating.

Outer coating 61 can be a non-conductive coating on a conductive core 63, for example, a Teflon® coating can be applied to a conductive core 63. Necessarily, however, if 61 is a non-conductive coating it must be capable of withstanding the thermal energy generated by conductive core 63. Rectangular core 67, with coating 65 is another possible embodiment of the present invention, wherein core 67 and coating 65 can both be conductive elements, core 67 can be conductive while coating 65 can be a protective coating, non-stick coating or other non-conductive material, or core 67 and coating 65 can both be conductive materials. The four cross-sections schematically shown in FIG. 5 are intended to be exemplary and other cross-sectional configurations, for example, elements with three or more layers of conductive and non-conductive materials, are suitable for use with the grill elements described herein.

Figure 6:
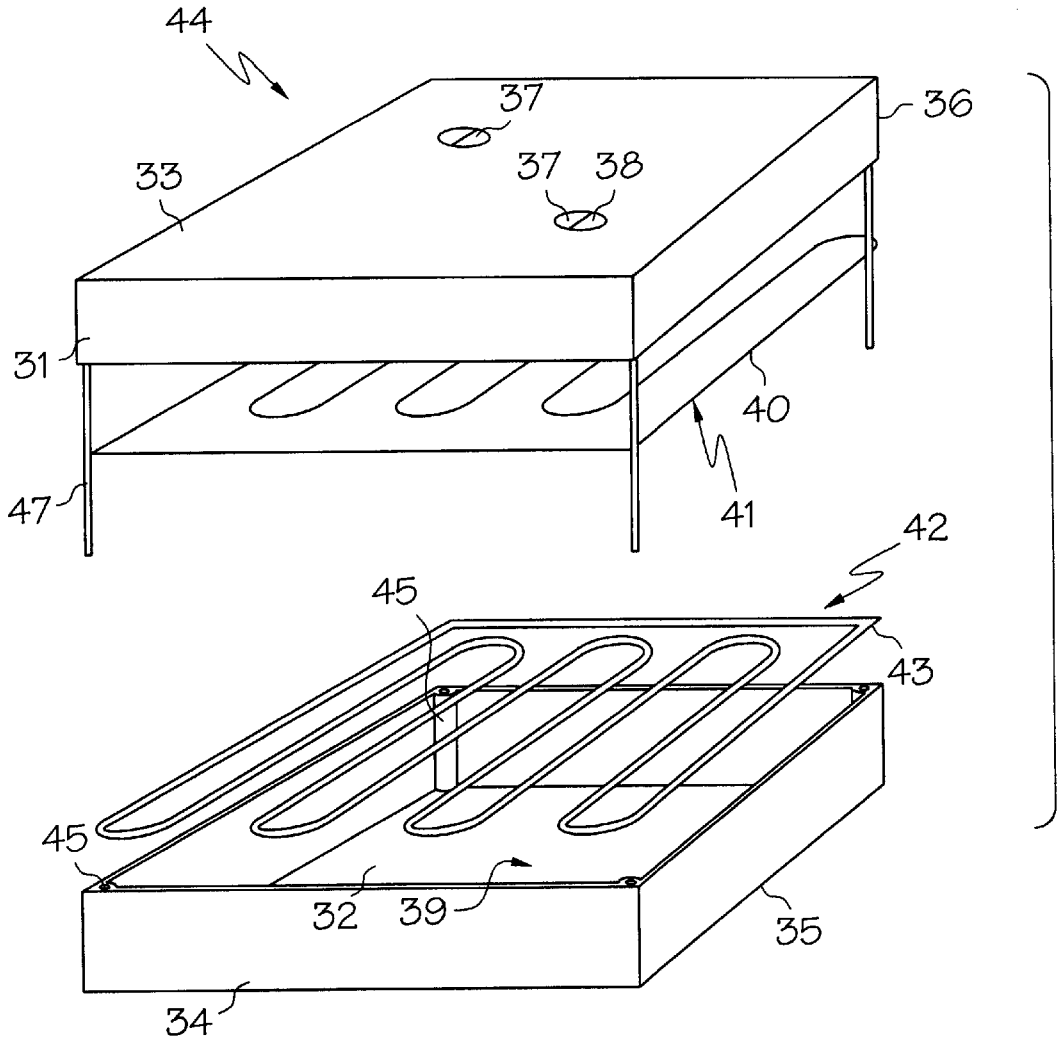
FIG. 6 is a schematic exploded view of one preferred microwave cooking apparatus according to the present invention.

FIG. 6 shows an exploded view of a microwave grilling apparatus 44 according to the present invention. The microwave grilling apparatus 44 comprises a grill 42, which comprises a continuous conductive grill element 43, and a tray 35 comprising tray walls 34 and a tray floor 32. The tray walls 34 and tray floor 32 form a tray interior 39 which is intended to contain or absorb liquids, for example the juices that drip off of a comestible, i.e. a food product, while it is being grilled. It is preferred, although not required, that grill element 43 be separated slightly from tray floor 32. Grill element 43 can be supported by tray walls 34, although other independent means of separating grill element 43 from tray floor 32 can be used. For example, if the ends of grill element 43 are insulated as shown in FIG. 3, the insulation can be made thick enough to separate grill element 43 from tray floor 32 by the desired distance. Grill element 43 can lay flat on tray floor 32, but it is generally preferred that there by a space between tray floor 32 and grill element 43 to allow liquid and/or air to flow beneath the surface of the comestible being grilled thereon.

While the grill elements described herein are suitable for use without a tray, trays are generally preferred to collect liquids, for example, juices which may seep out of the comestible being grilled, and/or to raise the grill element slightly to provide an area for air flow beneath the comestible. Thus, tray 35 is not necessary for the operation of the microwave grills described herein, although trays are generally preferred.

Leg receptacles 45 are shown adjacent the corners of tray 35. Leg receptacles 45 receive legs 47 to align and secure a cover 36 with tray 35. As can be appreciated, cover 36 is optional and may be used to envelope the comestible, for example, to retain the thermal energy generated during the grilling and microwave cooking process. Cover 36 comprises walls 31 and cover ceiling 33. Vent holes 38 with dampeners 37 are shown on the cover ceiling 33 wherein vent holes 38 can be opened and closed by dampeners 37 to relieve heat, steam and the like. A second grill 41 is shown which comprises a continuous conductive grill element 40 which can be used with or without cover 36. As can be appreciated, it is preferable to have grill elements, for example 40 and 43, on two sides of the comestible being grilled so that grilling is substantially uniform on the two sides without the need for turning the comestible during the grilling process. Thus, to grill in a microwave oven, at least one grill element, for example 43, is required, but two grill elements are preferred.

Although a generally rectangular configuration is schematically shown in FIG. 6 for microwave grilling apparatus 44, round grill apparatuses, and other geometric configurations are suitable for use with the microwave grills described herein. Likewise, while the legs 47 are shown as associated with cover 36 with the leg receptacles 45 being associated with tray 35, the number and placement of legs and their corresponding leg receptacles is a matter of choice and can be varied where appropriate. All materials in the microwave grilling apparatuses described herein, except for the grills, are preferably transparent to microwave energy. The trays, legs, dampeners, and other non-grill items, should preferably be made of plastic, ceramic, cardboard, and the like.

Figure 7:
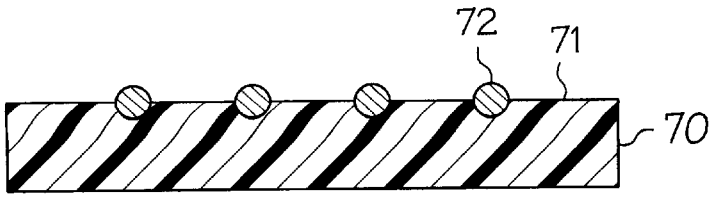
FIG. 7 is a cross-sectional view of a continuous grill element loop of the present invention imbedded in a non-conductive substrate.

FIG. 7 displays a schematic cross-section of a grill element 72 of the present invention which has been incorporated into a non-conductive surface 70. Non-conductive surface 70 can be, for example, a flat plate of plastic, fiber glass, ceramic, or other material which is generally transparent to microwave energy. Grill element 72, as can be appreciated, should be slightly raised above the surface 71 of non-conductive substrate 70 to increase the contact with the comestible being grilled. Non-conductive substrate 70, with grill element 72 incorporated therein, can be used as a microwave grill, or they can be used with a tray, for example, 35 and 36. Likewise, non-conductive substrate 70 can form either or both of the tray floor 32 or ceiling 33. The configuration of FIG. 7 is presented merely as an alternative embodiment of the present invention and it is understood that one of ordinary skill in the art could design a microwave grilling apparatus using one or more of the disclosed embodiments or modifications thereof.

Figure 8:
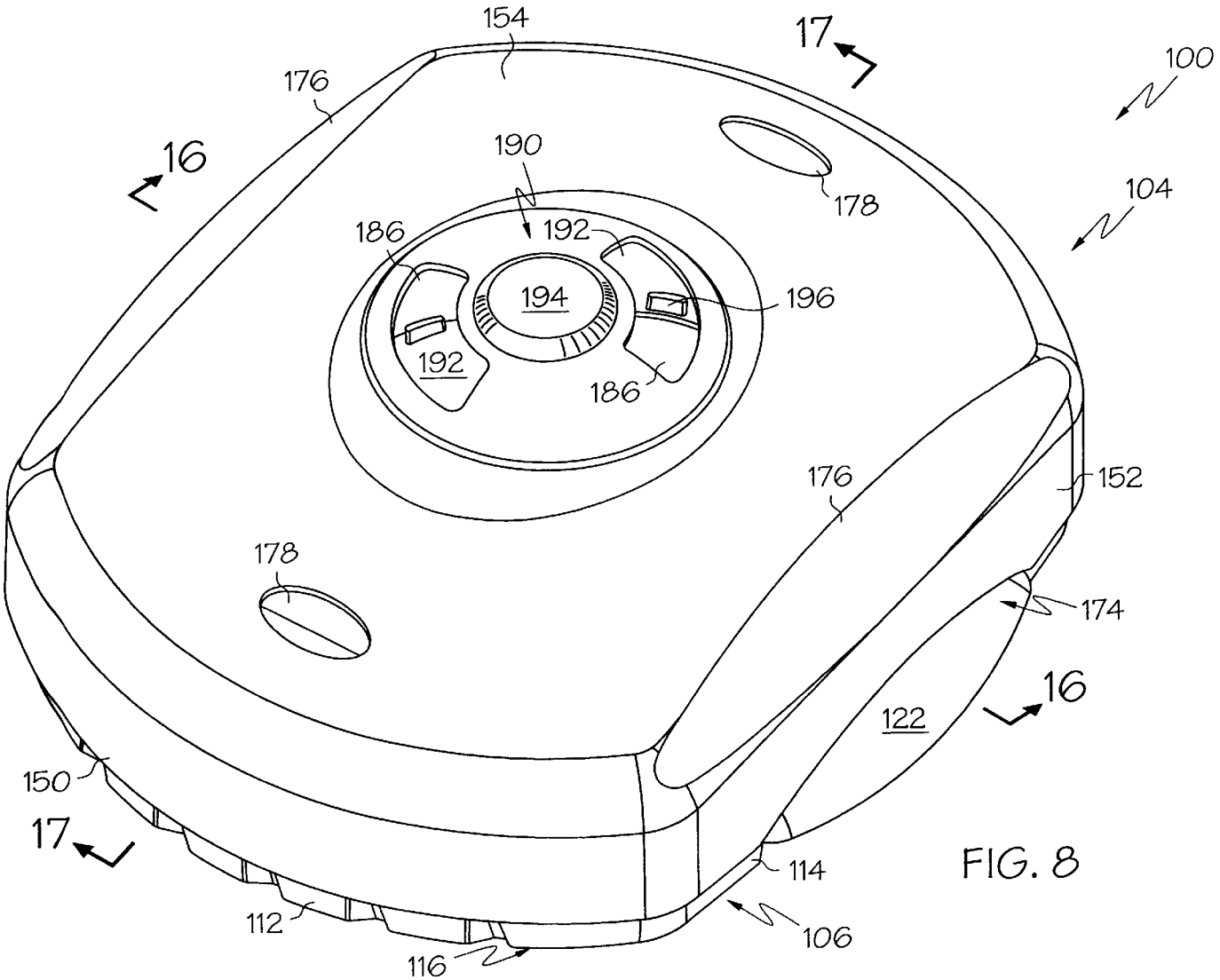
FIG. 8 is a perspective view of an embodiment of the microwave cooking grill and steamer of the present invention.

A microwave grill and steaming according to another aspect of the present invention is shown in FIG. 8 and is indicated at 100. Generally, the microwave grill and steamer of the present invention includes a tray adapted to hold a liquid, a lid which extends over the tray to close the apparatus and which forms a chamber with the tray, and a rack arranged within the chamber. The rack includes a grilling surface and a steaming surface, and has a microwave absorbing material, such as a grill element for example, on the grilling surface. The rack is adapted to support a comestible above the liquid, and is movable from a grilling position (in which the absorbing material is adapted to contact a comestible supported on the rack for grilling) to a steaming position (in which the steaming surface is adapted to contact a comestible supported on the rack for steaming.) Preferably, the microwave grill and steamer includes a shielding plate arranged within the chamber above the rack and adapted to block a portion of the microwave energy from a comestible supported on the rack. It is also preferred that a portion of the microwave absorbing material extends out from the grilling surface of the rack, to aid in contact with a comestible.

Figure 11:
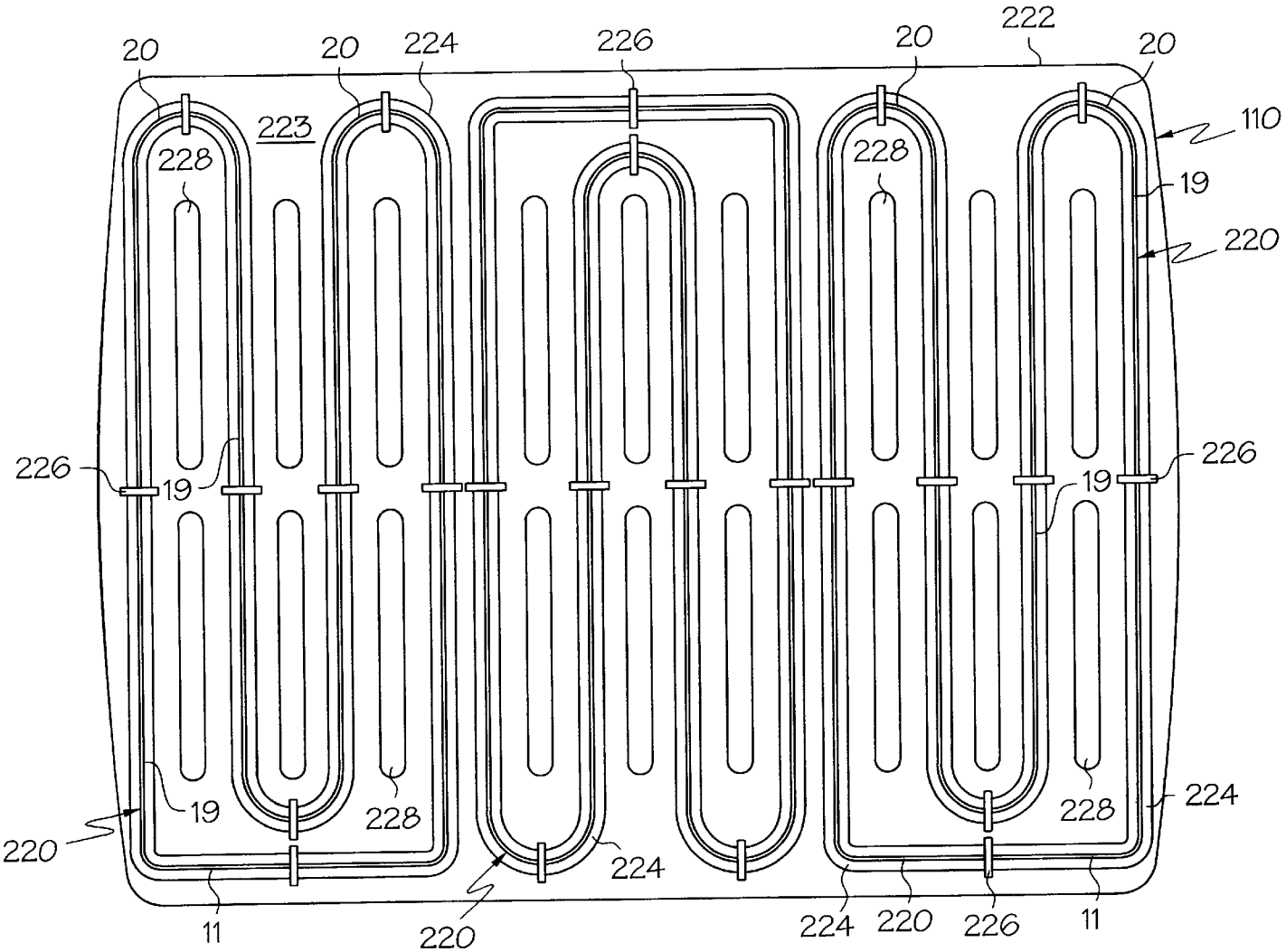
FIG. 11 is a plan view of the grilling assembly showing the grill element of FIG. 10 attached to a grilling and steaming rack for use in the grill and steamer of FIG. 8.

In a preferred embodiment, microwave grill and steamer 100 of FIG. 8 includes a lid 104, a base or tray 106, and a pair of grill assemblies 110 (shown in detail in FIG. 11). In the preferred embodiment, lid 104 and tray 106 are formed of a material which is transparent to microwaves, allowing the microwave energy to permeate therethrough. For example, a hard plastic material could be utilized.

Figure 9:
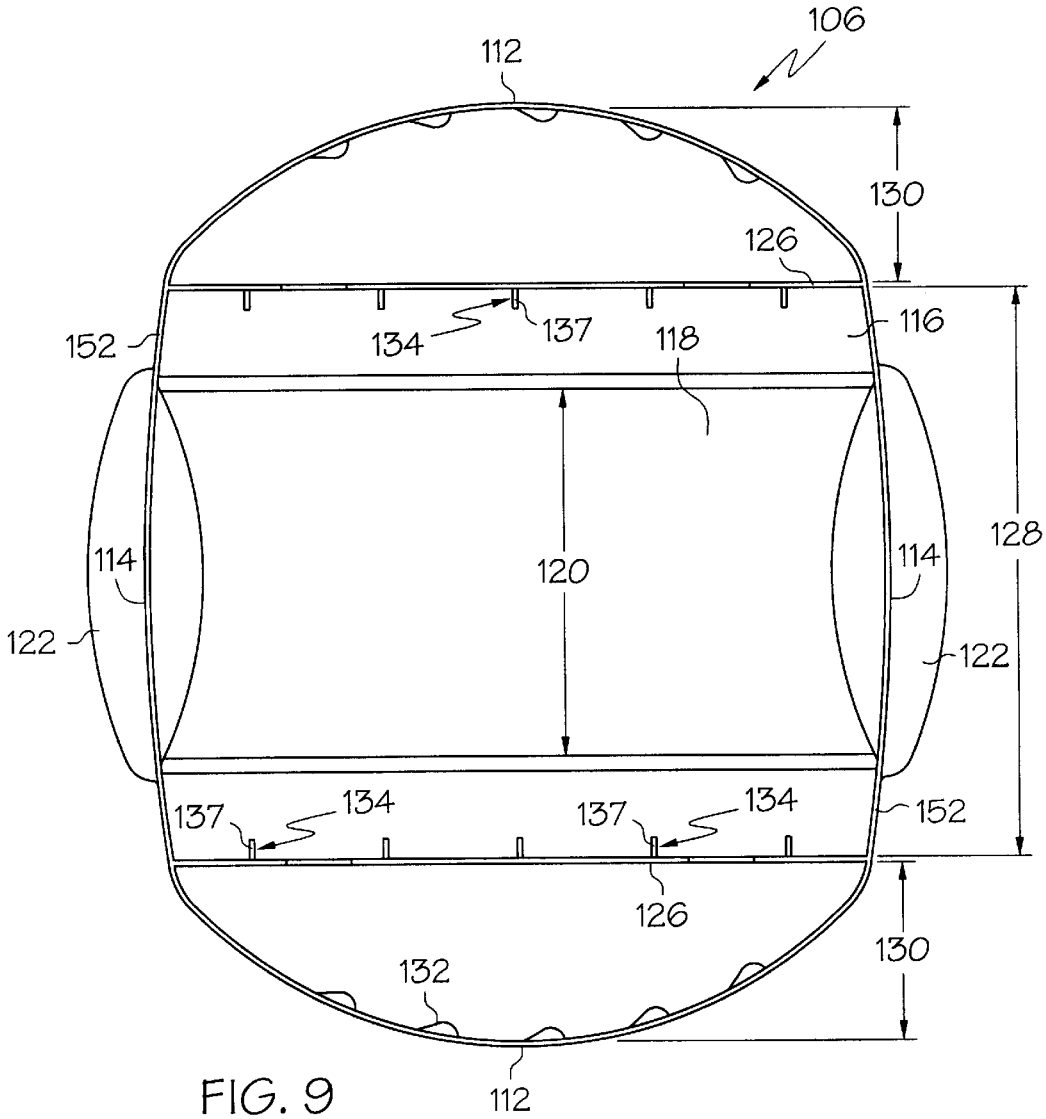
FIG. 9 is a top plan view of the base of the microwave cooking grill and steamer of FIG. 8.

Turning now to FIGS. 8 and 9, tray 106 may be of any desired shape but preferably is substantially oval-shaped having arcuate shaped end walls 112 which are formed with a considerable curve and arcuate shaped sidewalls 114 which are formed with a slight curve. End walls 112 are integrally formed with sidewalls 1 14 and with a bottom wall 116 to form a storage compartment 118. Bottom wall 116 is formed with an arcuate middle section 120. A curved handle 122 extends outwardly from sidewalls 114 and forms a recessed area 124 between handles 122 and sidewalls 114 to receive a user's fingers when the microwave grill and steamer 100 is being lifted into and out of a microwave oven. Each end wall 112 is formed with a plurality of inwardly extending perturbances 132. A pair of spaced parallel inner walls 126 extend between sidewalls 114 to divide compartment 118 into a middle compartment 128 and a pair of end compartments 130. Each inner wall 126 includes a plurality of inwardly extending support ribs 134 which are formed integrally with bottom wall 116 and inner walls 126.

Figure 15:
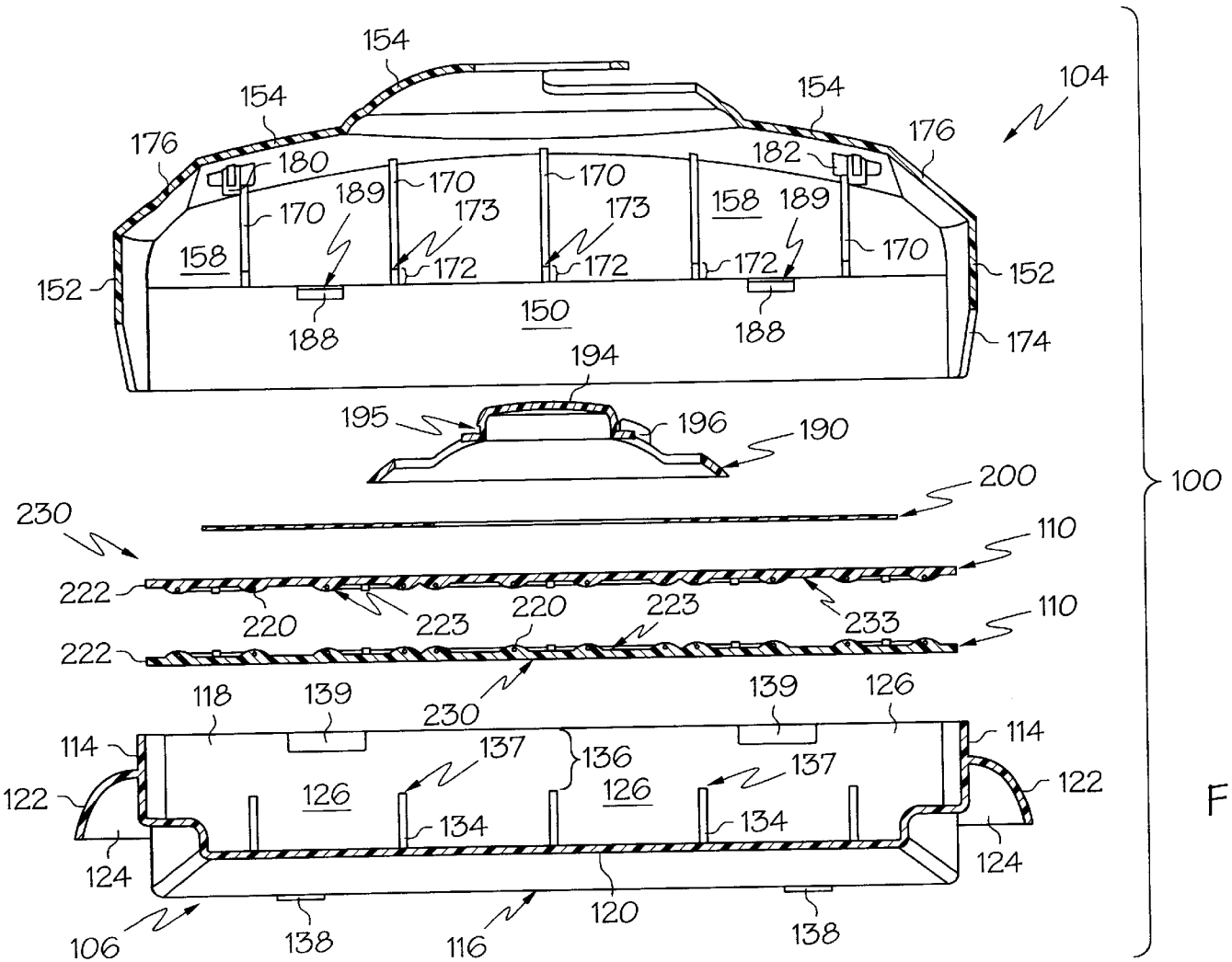
FIG. 15 is an exploded sectional view of the microwave grill and steamer of FIG. 8.

As best shown in FIG. 15, support ribs 134 extend perpendicular to and partially up inner walls 126 forming a lower shelf area 136 between a top 137 of support ribs 134 and the top of inner walls 126. A pair of generally rectangular-shaped cutouts 139 are formed in inner walls 126. Tray 106 includes a plurality of feet 138 which support bottom wall 116 slightly above a horizontal support surface.

Figure 14:
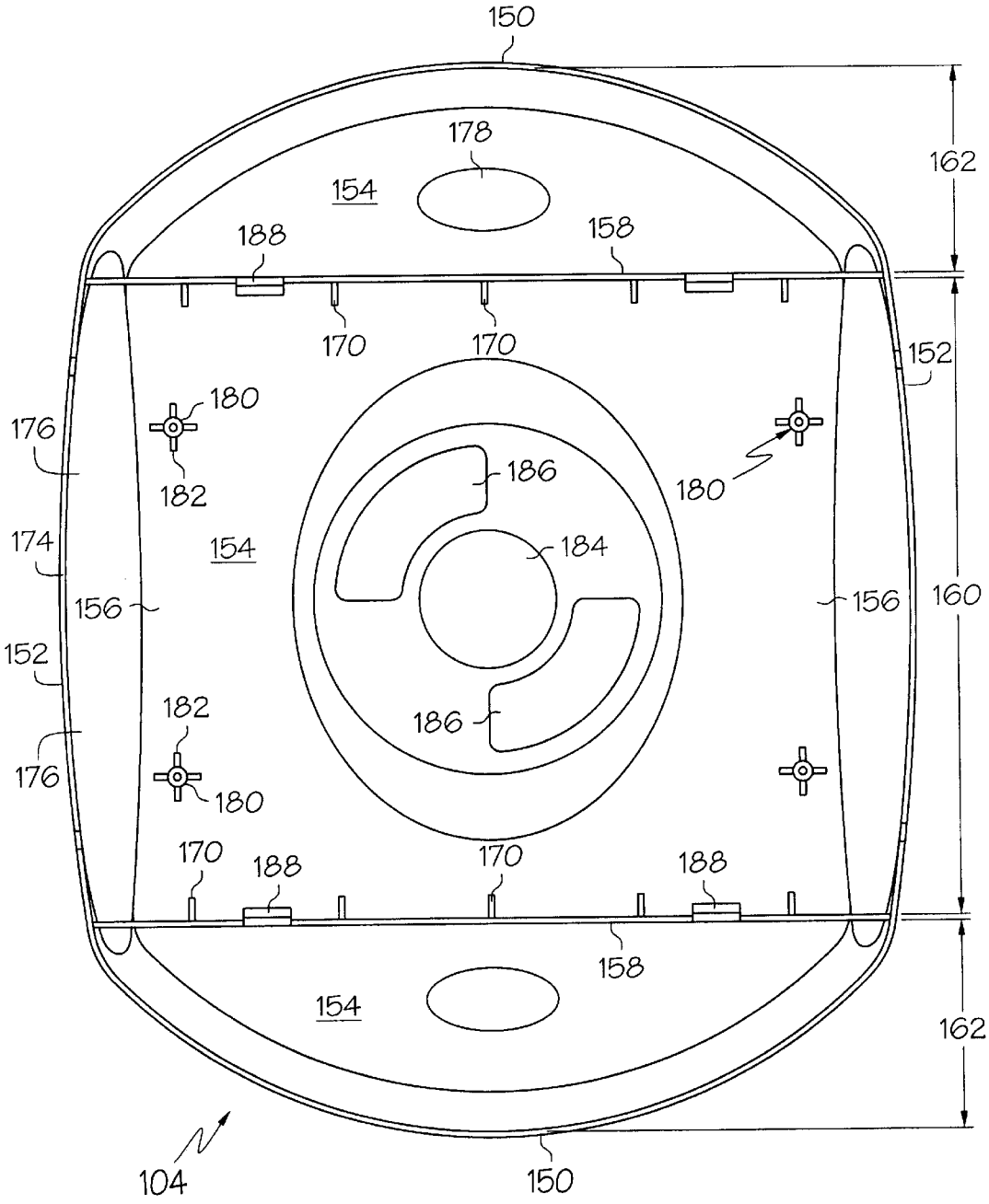
FIG. 14 is a bottom plan view of the lid of the microwave grill and steamer of FIG. 8.

Turning now to FIGS. 8 and 14, lid 104 is substantially similar in shape to tray 106 and preferably includes arcuate shaped end walls 150 which are formed with a considerable curve, and arcuate shaped sidewalls 152 which are formed with a slight curve. End walls 150 are formed integrally with sidewalls 152 and with a top wall 154 to form a top compartment 156. Lid 104 includes a pair of spaced parallel inner walls 158 which extend between sidewalls 152 and separate top compartments 156 into a middle compartment 160 and a pair of end compartments 162. In the illustrated embodiment, end walls 150 and sidewalls 152 form a length and a width of lid 104 which is slightly larger than the length and width of base tray 106, allowing lid 104 to extend over and partially cover base tray 106, as best shown in FIG. 8, when the grill and steamer 100 is in a closed position. Each inner wall 158 includes a plurality of inwardly extending support ribs 170 which are formed integrally with top wall 154 and inner walls 158.

As best shown in FIG. 15, support ribs 170 extend perpendicular to and partially down inner walls 158 forming an upper shelf area 172 between a bottom 173 of ribs 170 and the bottom of inner walls 158. A pair of clips 188 extend outwardly from and in the same direction as each inner wall 158. Clips 188 include latching shoulder 189 which extends inwardly perpendicular to walls 158. Clips 188 hold one of grill assemblies 110 to lid 104 when the microwave grill and steamer 100 is in an assembled configuration. However, it is contemplated that any of a variety of devices could be utilized for holding the assembly 110 to the lid 104, such as support pins, for example.

Figure 16:
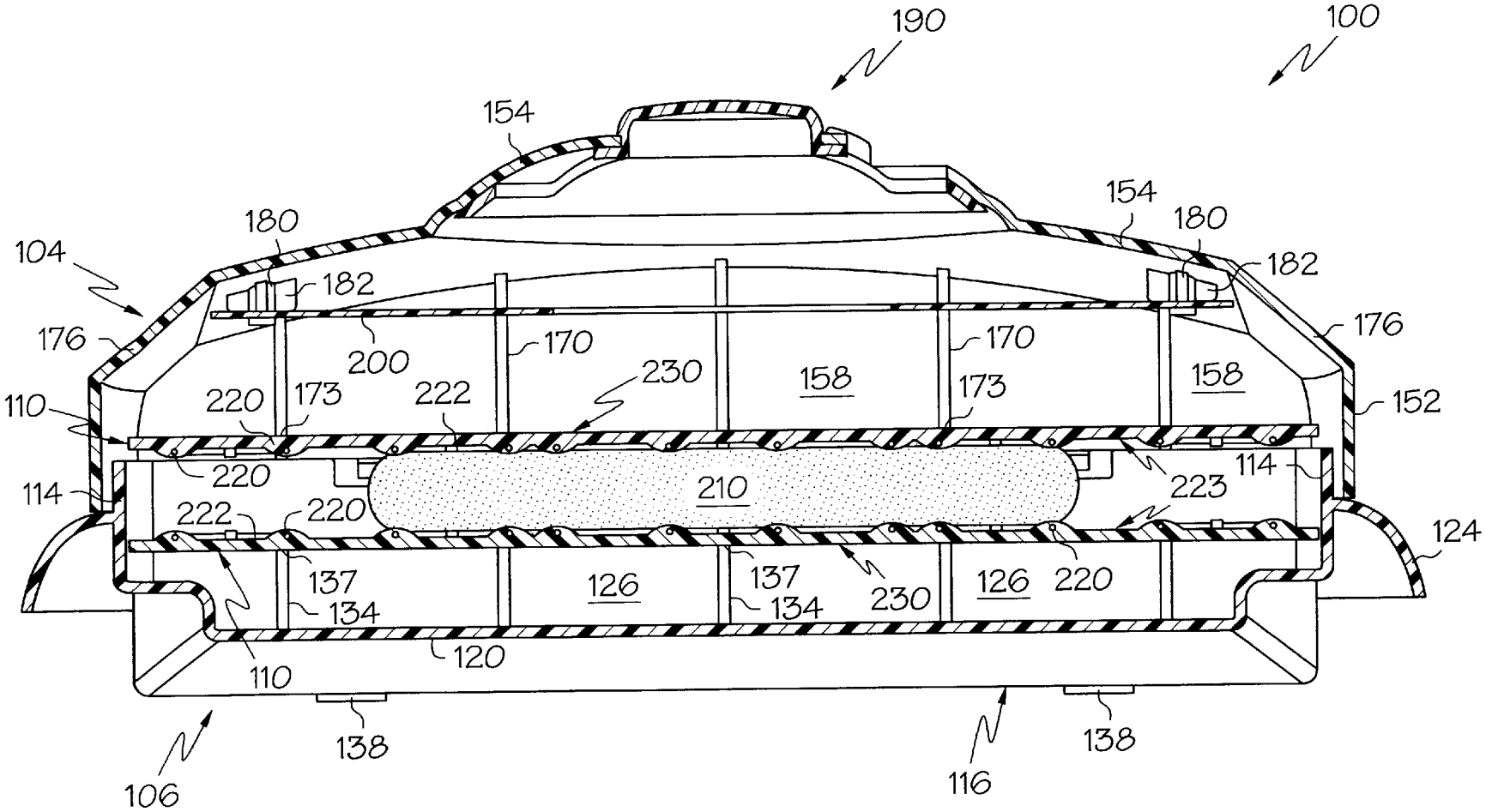
FIG. 16 is a sectional view of the grill and steamer of FIG. 8 taken along line 16—16, and shown grilling a comestible.
Figure 17:
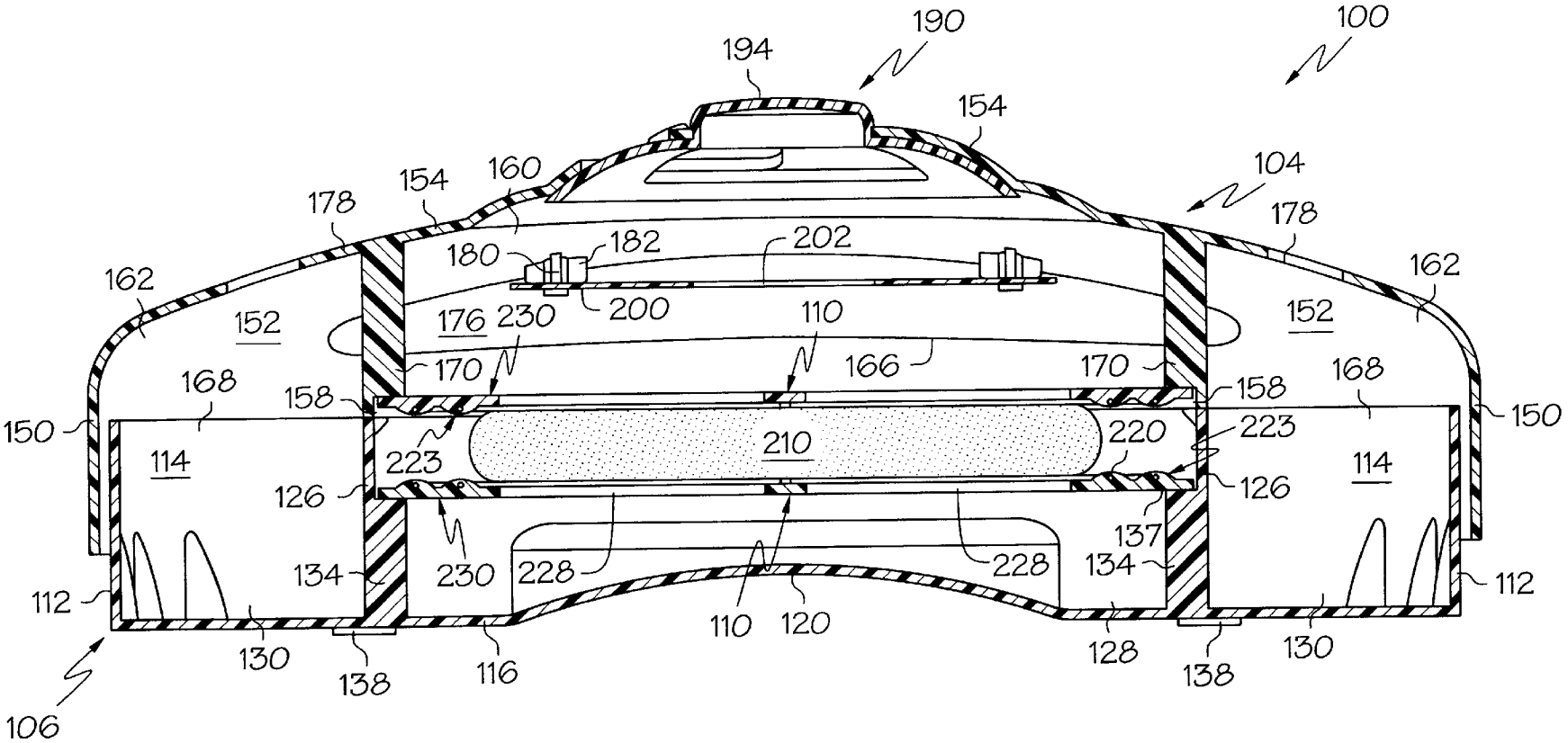
FIG. 17 is a sectional view of the microwave grill and steamer of FIG. 8, taken along line 17—17, and shown grilling a comestible.

As shown in FIGS. 8 and 14, a curved cutout area 174 is preferably formed in each sidewall 152 for receiving handles 122 when lid 104 is in the closed position. Top wall 154 has a generally curved shape and includes angled portions 176 which connect sidewalls 152 to the sides of top wall 154. A pair of generally oval shaped end vent holes 178 are formed in top wall 154 of lid 104 adjacent end walls 150. Vent holes 178 communicate with end chambers 162 to allow steam and hot air to escape from chambers 162 as described below. Four generally cylindrical posts 180 extend outwardly from top wall 154 into middle compartment 160. Posts 180 have four stop tabs 182 which extend outwardly from posts 180 in a generally cross-shaped configuration. Posts 180 receive and support a shielding plate 200 as shown in FIGS. 16 and 17 and as described below in further detail. Top wall 154 is formed with a center circular hole 184 and a pair of curved vent holes 186 which are formed adjacent circular vent hole 184 and which diametrically oppose one another about circular hole 184. End walls 150 and sidewalls 152 of lid 104 extend adjacent the outer surface of end walls 112 and sidewalls 114, respectively, of tray 106.

As best shown in FIG. 17, when the microwave grill and steamer 100 is in the closed position, lid 104 and tray 106 form an inner chamber. Inner walls 126 and 158 separate the inner chamber whereby middle compartments 128 and 160 of tray 106 and lid 104 form a middle chamber 166 and end compartments 130 and 162 cooperate to form end chambers 168. Inner walls 158 of lid 104 have a height substantially shorter than end walls 150 and sidewalls 152 to allow lid 104 to extend over and cover tray 106.

Figure 13:
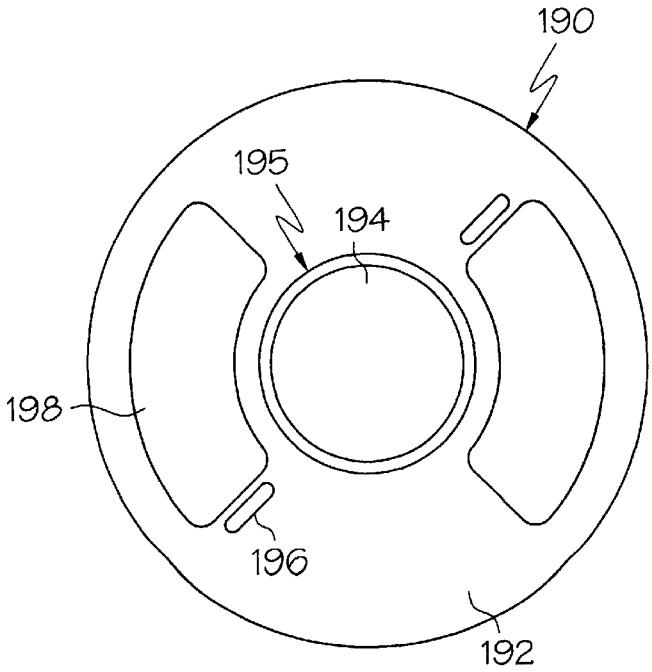
FIG. 13 is a top plan view of a steam vent, such as can be used with the grill and steamer of the embodiment of FIG. 8.

Turning now to FIGS. 8 and 13, a generally conical-shaped vent 190 snap-fits with circular hole 184 of lid 104 to selectively open and close curved vent holes 186. Vent 190 includes a generally conical body portion 192, a top circular knob 194 and a pair of outwardly extending stops 196. A groove 195 is formed between body portion 192 and knob 194 allowing vent 190 to snap-fit with lid 104, as described below. Vent 190 is formed with a pair of curved vent holes 198 which are similar in shape and size to vent holes 186 of lid 104 and which align with vent holes 186 when vent 190 is rotated to an open position. Knob 194 may also be used to rotate vent 190 whereby the solid portion of body 192 aligns with curved vent holes 186 closing vent holes 186 and preventing steam or hot air from escaping middle chamber 166. Stops 196 extend upwardly through curved vent holes 186 to limit the rotational movement of vent 190 as vent 190 is rotated between the open and closed positions.

Figure 12:
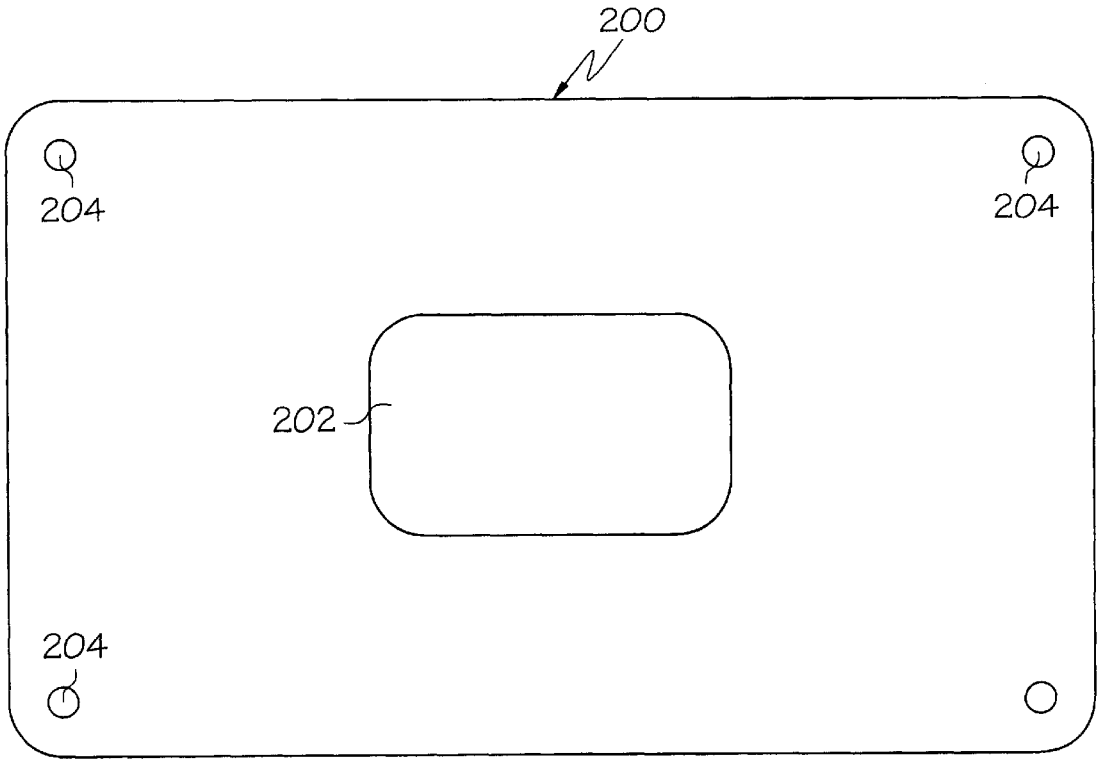
FIG. 12 is a plan view of a shielding plate of the grill and steamer of FIG. 8.

In accordance with one of the features of the invention and as best shown in FIGS. 12 and 16, a shielding plate 200 attaches to lid 104 to reflect or block a portion of the microwave energy being transmitted through lid 104 to the food being cooked by microwave cooking grill and steamer 100. Shielding plate 200 is preferably a thin piece of material having a small electrical conductivity and a large magnetic permeability to reflect microwaves. In the preferred embodiment, shielding plate 200 is formed of a material having some metal alloys and ferrites. In the illustrated embodiment, shielding plate 200 is generally rectangular shaped and is formed with a relatively small rectangular opening 202 which allows a small amount of microwaves to pass therethrough and assist in the cooking of a comestible 210. Four circular holes 204 are formed in shielding plate 200 adjacent the corners thereof which align with posts 180 of lid 104. Circular holes 204 have a diameter slightly less than posts 180 whereby holes 204 receive posts 180 to frictionally retain shielding plate 200 to lid 104. Caps (not shown) can be fitted over the posts 180 to aid in securing the shielding plate 200 to the lid 104. When microwave cooking grill and steamer 100 is in an assembled position, shielding plate 200 abuts stop tabs 182 allowing stop tabs 182 to place shielding plate 200 in a substantially horizontal position.

Figure 10:
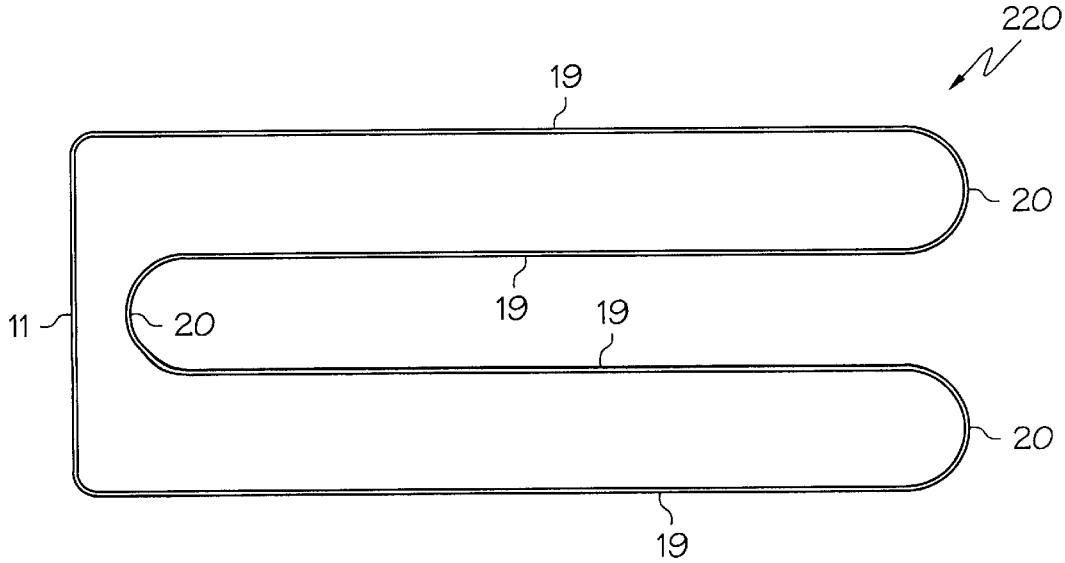
FIG. 10 is a top plan view of one of the grill element loops of the microwave cooking grill and steamer of FIG. 8.

Turning now to FIGS. 10 and 11, in accordance with another of the features of the invention, microwave cooking grill and steamer 100 includes a plurality of grill elements 220 which are preferably substantially similar in shape, configuration, and dimension to continuous grill element loop 10 of FIG. 2, except that loop 220 includes four linear grill segments 19 and three rounded crossovers 20. Preferably, and as described above with respect to the other grill element embodiments, the grill element loop 220 has a total length equal to about $X^*(\frac{1}{2}\lambda)$, each of the linear segments 19 has a length of about $Y^*(\frac{1}{2}\lambda)$, and the linear segments 19 are spaced apart by a distance which is equal to about $Z^*(\frac{1}{2}\lambda)$ (wherein X, Y, and Z are integers from 1 to about 24, and wherein $\lambda$ is the wave length of microwave energy which is in the range of from about 11.5 cm to about 14.0 cm). However, it is contemplated that other grill elements could be utilized with the microwave grill and steamer, such as microwave absorbing suceptors. In the preferred embodiment, the microwave grill and steamer 100 includes grill assemblies 110 which each include three grill elements 220 attached to a grilling surface 223 of a rack 222. Rack 222 is generally rectangular in shape and is formed with three grill receiving channels 224 which are similar in shape to grill elements 220 and which receive grill elements 220 therein. A plurality of fasteners 226 are formed integrally with rack 222 and extend over grill receiving channels 224 to retain grill elements 220 within grill receiving channels 224. Grill receiving channels 224 have a depth slightly less than the diameter of grill elements 220 to allow grill elements 220 to extend beyond flat grilling surface 223 of rack 222. A plurality of elongated relatively narrow openings 228 are formed in rack 222 between segments 19 of grill elements 220 to allow either liquids such as juices from the comestible or steam to pass therethrough as described below. Racks 222 have a steaming surface 230 opposite that of grilling surface 223. Preferably, the racks 222 and fasteners 226 are made of a plastic material which is transparent to microwave energy.

As can be best seen in FIGS. 15–17, microwave cooking grill and steamer 100 can be assembled by placing one of the two grill assemblies 110 between inner walls 126 of tray 106 whereby steaming surface 230 of rack 222 rests on top 137 of support ribs 134 within shelf area 136. Vent 190 is inserted upwardly through middle compartment 160 of lid 104 whereby knob 194 extends through circular vent hole 184 until groove 195 snap-fits with the edge of vent hole 184 to retain vent 190 to lid 104. Shielding plate 200 is inserted within middle compartment 160 of lid 104 whereby circular holes 204 of shielding plate 200 receive plastic posts 180 of top wall 154 frictionally retaining shielding plates 200 to lid 104. As described above, stop tabs 182 position shielding plate 200 in a horizontal position generally perpendicular to inner walls 158.

The second grilling assembly 110 is positioned with steaming surface 230 of rack 222 facing upwardly towards top wall 154. The upper grill assembly 110 is placed within upper shelf area 172 until steaming surface 230 thereof abuts the bottom end 173 of ribs 170 allowing latching shoulder 189 of clips 188 to engage grilling surface 223 and retain upper grill assembly 110 to lid 104.

Comestible 210 is placed on lower grill assembly 110 and contacts grill elements 220 which extend outwardly beyond grilling surface 223 of rack 222. Lid 104 is placed over tray 106 until either grill elements 220 of upper grill assembly 110 contact comestible 210 or the bottom end of inner walls 158 contact the top end of inner walls 126 to support lid 104. Clips 188 are spaced slightly from the bottom end of support ribs 170 to allow a small amount of vertical movement of upper grill assembly 110 when comestible 210 has a thickness greater than the distance between upper and lower grill assemblies 110. Thus, lid 104 may be supported on tray 106 by the contact between steaming surface 230 of upper grill assembly 110 with the bottom end of support ribs 170 caused by the abutment of upper grill assembly 110 with comestible 210.

Microwave cooking grill and steamer 100 operates in a substantially similar manner to microwave grilling apparatus 44 described above with the exception of shielding plate 200 which will shield a majority of the microwaves to substantially prevent comestible 210 from being cooked by the microwaves, whereby the comestible is substantially cooked by its contact with the grill elements. Opening 202 of shielding plate 200 does allow a small amount of microwave energy to pass therethrough and perform a small amount of microwave cooking. Openings 228 of rack 222 allow juices or other liquids from comestible 210 to flow into middle compartment 128 of tray 106 where the liquid is held until emptied by the user. Curved middle section 120 of bottom wall 116 directs the liquid to the ends of middle compartment 128 to prevent splashing as the liquid flows through openings 228.

Figure 18:
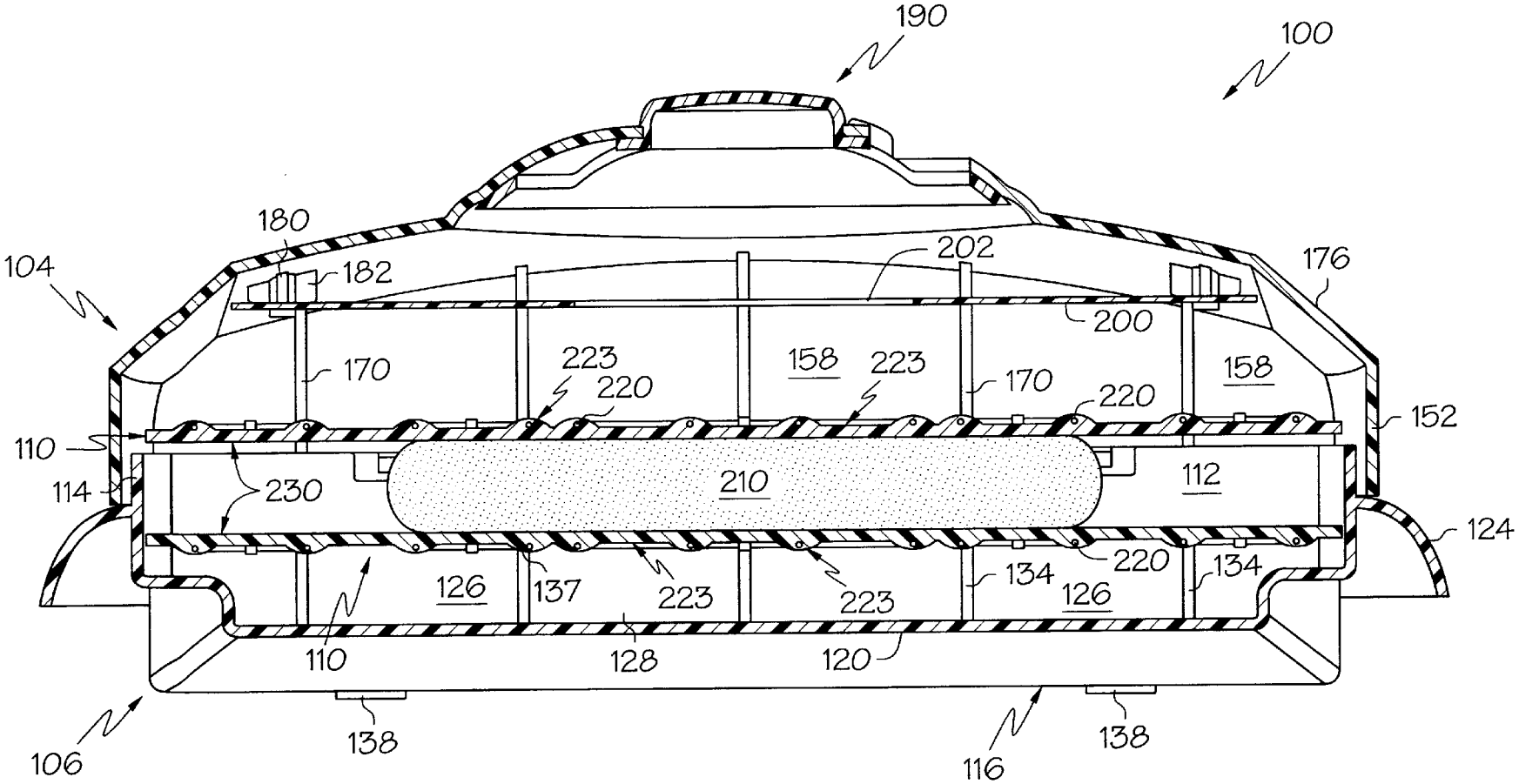
FIG. 18 is a sectional view similar to FIG. 16 showing the microwave grill and steamer in the steamer configuration, with the steamer surface of the rack in contact with the comestible and the grilling surface of the rack facing away from the comestible.

In accordance with another of the features of the invention and as shown in FIG. 18, grill assemblies 110 may be flipped over whereby steaming surface 230 of lower grill assembly 110 faces upward and steaming surface 230 of upper grill assembly 110 faces downward. Comestible 210 is then sandwiched between steaming surfaces 230 of grill assembly 110 and grill elements 220 are positioned on the opposite side of grill assemblies 210 away from contact with comestible 210.

In this configuration, microwave cooking grill and steamer 100 may be used to steam cook comestible 210 by filling middle compartment 128 of tray 106 with water, placing lid 104 over tray 106 and placing the microwave cooking grill and steamer 100 in a microwave apparatus. Shielding plate 200 blocks and reflects a majority of the microwave energy to substantially prevent the microwave energy from cooking comestible 210. Plastic tray 106 which is transparent to microwave energy allows the microwave energy to permeate therethrough to boil the water contained within middle compartment 128. As the water is heated to its boiling temperature, the water is converted into steam which rises upwardly through openings 228 of grill assemblies 110 to steam cook comestible 210.

Because a majority of the cooking time will be spent raising the temperature of the water contained within middle compartment 128 to its boiling point, this amount of time may be reduced by filling middle compartment 128 with water until the water contacts grill elements 220 of lower grill assembly 110. Because grill elements 220 are designed to absorb microwave energy, as described above, the microwave energy heats the grill elements which contact the water. The heated grill elements assist in heating the water, thus decreasing the amount of time required for the water to reach its boiling point. Again, a small amount of microwave energy will pass through rectangular opening 202 of shielding plate 200 to perform a small amount of cooking.

Whether microwave cooking grill and steamer 100 is used to grill (FIGS. 16–17) or steam (FIG. 18) comestible 210, a small amount of microwave energy will enter through the sides of microwave cooking grill and steamer 100 and perform a small amount of cooking at the sides of comestible 210. Turning to FIG. 17, food items may be placed in end compartments 130 of tray 106 allowing additional food items to be microwave cooked simultaneously with the grilling or steaming of comestible 210. Vent holes 178 allow the steam from the additional food items to escape from end chambers 168. Because shielding plate 200 is positioned within middle chamber 166, the microwave energy is not shielded from end chambers 168 allowing the microwave energy to permeate plastic lid 104 and tray 106 to microwave cook the food contained within end compartments 130.

Accordingly, the microwave cooking grill and steamer 100 includes grill assemblies 110 which may be positioned with the grill elements facing towards and contacting comestible 210 to grill cook the comestible in a microwave, as best shown in FIGS. 16–17. Further, grill assemblies 110 may be flipped whereby grill elements 220 face away from comestible 210 and the comestible is sandwiched between steaming surfaces 230 of racks 222, as best shown in FIG. 18. In this configuration, water is placed within middle compartment 128 of tray 106 and the microwaves heat the water to convert the water to steam which flows through openings 228 to cook comestible 210. Shielding plate 200 reflects and blocks a majority of the microwaves to prevent the microwaves from directly cooking comestible 210. Vent 190 is rotatable between open and closed positions allowing the amount of steam which flows through vent holes 186 to be controlled by the user.

The Detailed Description above will be better understood when read in conjunction with the following examples wherein the following examples utilized two, generally rectangular grills (e.g., 42 of FIG. 6), being approximately 6 cm (i.e., $4*(\frac{1}{8}\lambda)$) by 16.5 cm, wherein the element segment (e.g., D2, FIG. 2) lengths are approximately 12.7 cm (i.e., $2*(\frac{1}{2}\lambda)$). The comestible, e.g. chicken breast, fish, etc., was placed between the two grills. For all of the examples, the grilling process was observed from a window in the door of the microwave oven to see if arcing or localized overheating of the grill element occurred. Arcing is detected by the presence of sparks, and localized overheating is characterized by "glowing" areas on the conductive element (although the view of certain areas of the grill on the bottom of the comestible were obscured by the comestible).

EXAMPLE 1

An eight ounce boneless/skinless chicken breast was grilled using the grill described above. The continuous grill element was made of SS 312 with a cross sectional area of about 0.01 $cm^2$. A Sharp (Side-Fed-Oven) microwave oven, approximately 900 watts of power, operating at approximately 2450 MHZ, oven was used to grill the chicken breast. The chicken breast was fully cooked with grill marks on both sides within four minutes on the high power setting. No arcing or localized over heating of the element was observed.

EXAMPLE 2

A five ounce boneless, skinless chicken breast was cooked using the grill described above. The continuous grill element was made of SS 312 with a cross sectional area of about 0.006 $cm^2$. A Sharp (Side-Fed-Oven) microwave oven, approximately 900 watts of power, operating at approximately 2450 MHZ, oven was used to grill the chicken breast. The chicken breast was fully cooked with grill marks on both sides within three minutes on the high power setting. No arcing or localized over heating of the element was observed. The grill marks on the chicken breast surfaces were more intense as compared to the chicken breast of Example 1.

EXAMPLE 3

An eight ounce fish (halibut) steak was cooked using the grill described above. The continuous grill element was made of SS 312 with a cross sectional area of about 0.006 $cm^2$. An Amana (Top-Fed-Oven) microwave oven, approximately 700 watts of power, operating at approximately 2450 MHz, oven was used to grill the fish steak. The fish steak was fully cooked with grill marks on both sides within three minutes on the high power setting. No arcing or localized over heating of the element was observed.

EXAMPLE 4

Four hot dogs were cooked using the grill described above. The continuous grill element was made of SS 312 with a cross sectional area of about 0.006 $cm^2$. An Amana (Top-Fed-Oven) microwave oven, approximately 700 watts of power, operating at approximately 2450 MHz, was used to cook the hot dogs in 1 minutes and 30 seconds. The hot dogs were fully cooked with grill marks on both sides. No arcing or localized over heating of the element was observed.

The foregoing description of possible embodiments of the invention has been presented for purposes of illustration and description. It is not intended to be exhaustive or to limit the invention to the precise form disclosed, and modifications and variations are possible in light of the above teachings. For example, while preferred configurations and shapes of the elements of the microwave grill and steamer have been described, it is contemplated that other configurations and shapes could be utilized without departing from the scope of the invention. The embodiments were chosen and described in order to best illustrate the principles of the invention and its practical application to thereby enable one of ordinary skill in the art to best utilize the invention in various embodiments and with various modifications as are suited for the particular use contemplated. Accordingly, it is intended that the scope of the invention be defined by the claims appended hereto.

What is claimed is:

1. A combination microwave grilling and steaming apparatus adapted to grill or steam a comestible using microwave energy, said apparatus including:

a tray adapted to hold a liquid;

a lid which extends over the tray to close the apparatus, said lid and tray forming a chamber therebetween;

a rack having a grilling surface and a steaming surface, the rack being arranged within the chamber and adapted to support a comestible apart from a liquid on the tray wherein the grilling and steaming surfaces are opposing surfaces;

a first grill element attached to the grilling surface of the rack, the rack being rotatably movable from a grilling position in which the first grill element is positioned to contact a comestible supported on the rack, to a steaming position in which the steaming surface is positioned to contact a comestible supported on the rack and in which the first grill element is positioned to face toward a liquid in the tray; and a shielding plate arranged within the chamber above the rack and adapted to block a portion of the microwave energy from a comestible supported on the rack.

2. The combination microwave grilling and steaming apparatus as recited in claim 1, wherein the grill element comprises a continuous loop of wire having:

two spaced linear segments; and a crossover segment serially connecting the two spaced linear segments, wherein substantially the entire loop is capable of collecting microwave energy without use of designated antenna portions.

3. The combination microwave grilling and steaming apparatus as recited in claim 1, wherein the grill element comprises a continuous conductive loop having spaced linear segments, wherein the total length of the loop is equal to about $X^*(\frac{1}{2}\lambda)$, wherein adjacent linear segments are spaced apart by a distance which is equal to about $Z^*(\frac{1}{8}\lambda)$, wherein X and Z are integers from 1 to about 24, and wherein $\lambda$ is the wave length of microwave energy which is in the range of from about 11.5 cm to about 14.0 cm.

4. The combination microwave grilling and steaming apparatus as recited in claim 1, wherein a portion of the first grill element extends out from the grilling surface of the rack.

5. The combination microwave grilling and steaming apparatus as recited in claim 1, wherein the rack includes a channel and the first grill element is provided at least partially within the channel.

6. The combination microwave grilling and steaming apparatus as recited in claim 1, wherein the lid and tray include inner walls which divide the chamber into first and second compartments, wherein the rack and the shielding plate are provided entirely within the first compartment, and wherein the tray and lid are transparent to microwave energy.

7. The combination microwave grilling and steaming apparatus as recited in claim 1, wherein first grill element is adapted to contact a liquid held in the tray when the rack is in the steaming position.

8. The combination microwave grilling and steaming apparatus as recited in claim 1, wherein the tray includes ribs for supporting the rack.

9. The combination microwave grilling and steaming apparatus as recited in claim 1, wherein the first grill element comprises:

a continuous conductive loop having a cross-sectional surface area of between about $5\times10^{-3}$ $cm^2$ to about 0.1 $cm^2$, the loop comprising:

two spaced linear segments; and a crossover segment serially connecting the two spaced linear segments, wherein substantially the entire loop is capable of collecting microwave energy without use of designated antenna portions.

10. A combination microwave grilling and steaming apparatus adapted to grill or steam a comestible using microwave energy, said apparatus including:

a tray adapted to hold a liquid;

a lid which extends over the tray to close the apparatus, said lid and tray forming a chamber therebetween;

a rack having a grilling surface and a steaming surface, wherein the grilling and steaming surfaces are on opposing surfaces, wherein the rack includes microwave absorbing material on the grilling surface, wherein the steaming surface comprises a material substantially transparent to microwave energy, wherein the rack is arranged within the chamber and adapted to support a comestible above the liquid, and wherein the rack is rotatable movable from a grilling position in which the microwave absorbing material is adapted to contact a comestible supported on the rack for grilling, to a steaming position in which the steaming surface is adapted to contact a comestible supported on the rack for steaming.

11. The apparatus as recited in claim 10, wherein the microwave absorbing material comprises a continuous conductive grill element loop.

12. The apparatus as recited in claim 10, wherein the microwave absorbing material comprises:

a continuous conductive loop having a cross-sectional surface area of between about $5\times10^{-3}$ $cm^2$ to about 0.1 $cm^2$, the loop comprising:

two spaced linear segments; and a crossover segment serially connecting the two spaced linear segments, wherein substantially the entire loop is capable of collecting microwave energy without use of designated antenna portions.

13. The apparatus as recited in claim 10, wherein the microwave absorbing material is configured to contact a liquid held in the tray when the rack is in the steaming position.

14. The apparatus as recited in claim 10, wherein the tray comprises ribs configured to support the rack.

15. The apparatus as recited in claim 10, wherein the lid and tray include inner walls which divide the chamber into at least two compartments.

16. The apparatus as recited in claim 15, wherein the rack is provided entirely within one of the compartments.

17. The apparatus as recited in claim 10, wherein the microwave absorbing material extends out from the grilling surface of the rack.

18. The apparatus as recited in claim 10, wherein the microwave absorbing material comprises:

a continuous conductive loop having spaced linear segments, wherein the total length of the loop is equal to about $X^*(\frac{1}{2}\lambda)$, wherein adjacent linear segments are spaced apart by a distance which is equal to about $Z^*(\frac{1}{8}\lambda)$, wherein X and Z are integers from 1 to about 24, and wherein $\lambda$ is the wave length of microwave energy which is in the range of from about 11.5 cm to about 14.0 cm.

19. The apparatus as recited in claim 10, wherein the microwave absorbing material comprises a continuous loop of wire having:

two spaced linear segments; and a crossover segment serially connecting the two spaced linear segments, wherein substantially the entire loop is capable of collecting microwave energy without use of designated antenna portions.

20. A combination microwave grilling and steaming apparatus adapted to grill or steam a comestible using microwave energy, said apparatus including:

a tray adapted to hold a liquid;

a lid which extends over the tray to close the apparatus, said lid and tray forming a chamber therebetween;

a rack having a grilling surface and a steaming surface, the rack being arranged within the chamber and adapted to support a comestible apart from a liquid on the tray;

a first grill element attached to the grilling surface of the rack, the rack being movable from a grilling position in which the first grill element is positioned to contact a comestible supported on the rack, to a steaming position in which the steaming surface is positioned to contact a comestible supported on the rack; and a shielding plate arranged within the chamber above the rack and adapted to block a portion of the microwave energy from a comestible supported on the rack;

wherein the grill element comprises a continuous loop of wire having:

two spaced linear segments; and a crossover segment serially connecting the two spaced linear segments, wherein substantially the entire loop is capable of collecting microwave energy without use of designated antenna portions.

21. A combination microwave grilling and steaming apparatus adapted to grill or steam a comestible using microwave energy, said apparatus including:

a tray adapted to hold a liquid;

a lid which extends over the tray to close the apparatus, said lid and tray forming a chamber therebetween;

a rack having a grilling surface and a steaming surface, wherein the rack includes microwave absorbing material on the grilling surface, wherein the rack is arranged within the chamber and adapted to support a comestible above the liquid, and wherein the rack is movable from a grilling position in which the microwave absorbing material is adapted to contact a comestible supported on the rack for grilling, to a steaming position in which the steaming surface is adapted to contact a comestible supported on the rack for steaming;

wherein the microwave absorbing material comprises:

a continuous loop of wire having:

two spaced linear segments; and a crossover segment serially connecting the two spaced linear segments, wherein substantially the entire loop is capable of collecting microwave energy without use of designated antenna portions.

* * * * *